US005718998A

United States Patent [19]

Takahashi et al.

[11] Patent Number: 5,718,998

[45] Date of Patent: Feb. 17, 1998

[54] ELECTROPHOTOGRAPHIC PHOTORECEPTOR THE PHOTOSENSITIVE LAYER OF WHICH CONTAINS THE CHARGE GENERATING MATERIAL A FINE ORGANIC PIGMENT PREPARED FROM A SOLUBLE PIGMENT PRECURSOR

[75] Inventors: Ryuichi Takahashi, Kobe; Kazuyo Yamamoto, Takarazuka, both of Japan; Abul Iqbal, Arconciel; Zhimin Hao, Marly, both of Switzerland

[73] Assignee: Ciba Specialty Chemical Holding, Inc., Basel, Switzerland

[21] Appl. No.: 577,333

[22] Filed: Dec. 22, 1995

[30] Foreign Application Priority Data

Dec. 22, 1994 [JP] Japan ..... 6-320810

[51] Int. Cl.[6] ..... G03G 5/14

[52] U.S. Cl. ..... 430/76; 430/78

[58] Field of Search ..... 430/71, 73, 78, 430/76

[56] References Cited

U.S. PATENT DOCUMENTS

| | | | |
|---|---|---|---|
| 2,662,895 | 12/1953 | Pedersen | 260/314.5 |
| 3,839,034 | 10/1974 | Wiedemann | 96/1.5 |
| 4,220,697 | 9/1980 | Wiedemann | 430/59 |
| 4,585,878 | 4/1986 | Jost et al. | 548/453 |
| 4,886,721 | 12/1989 | Hayashida et al. | 430/78 |
| 4,952,472 | 8/1990 | Baranyi et al. | 430/59 |
| 5,130,218 | 7/1992 | Yokokawa et al. | 430/71 |
| 5,344,734 | 9/1994 | Monbaliu et al. | 430/73 |
| 5,360,475 | 11/1994 | Nukada et al. | 106/410 |

FOREIGN PATENT DOCUMENTS

| | | |
|---|---|---|
| 0 628 880 | 12/1994 | European Pat. Off. . |
| 0 648 770 | 4/1995 | European Pat. Off. . |
| 0 648 817 | 4/1995 | European Pat. Off. . |
| 0 654 711 | 5/1995 | European Pat. Off. . |
| 2 237 680 | 2/1974 | Germany . |
| 2 734 288 | 2/1979 | Germany . |
| 2 948 790 | 7/1980 | Germany . |
| 4 029 565 | 3/1991 | Germany . |
| 4 215 201 | 11/1992 | Germany . |
| 2 265 724 | 10/1993 | United Kingdom . |

*Primary Examiner*—John Goodrow
*Attorney, Agent, or Firm*—Wenderoth, Lind & Ponack

[57] ABSTRACT

The invention is related to an electrophotographic photoreceptor, its preparation, and its use in electrophotography. The instant photoreceptor comprises a conductive substrate and a photosensitive layer containing an organic pigment as a charge generating material, wherein said organic pigment is formed from a soluble organic pigment precursor.

Particularly suitable soluble pigment precursors are of formulae (I) or (XIV), $A(D_1)(D_2)_x$ (I)

(XIV)

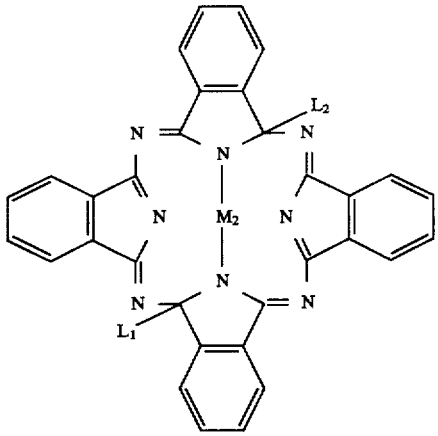

wherein A represents a chromophore residue which is a perylene, quinacridone, dioxazine, anthraquinone, azo, phthalocyanine, isoindolinone, isoindoline, indigo, quinophthalone or pyrrolopyrrole with 1 to 5 N atoms bound to the $D_1$ and $D_2$ groups, whereby each N atom of A is independently from the other bound to 0, 1 or 2 groups $D_1$ or $D_2$;

$D_1$ and $D_2$ are independently a group represented by the general formula

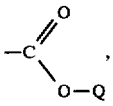

x is an integer from 0 to 4;

$L_1$ and $L_2$ are independently from one other halogen, alkoxy or amino groups, and $M_2$ is two hydrogens or a metal or oxometal with at least two valences;

as well as derivatives thereof.

The instant electrophotographic photoreceptors have hight sensitivity and low residual electric potential and can be obtained without applying any dispersion procedure.

21 Claims, No Drawings

ELECTROPHOTOGRAPHIC PHOTORECEPTOR THE PHOTOSENSITIVE LAYER OF WHICH CONTAINS THE CHARGE GENERATING MATERIAL A FINE ORGANIC PIGMENT PREPARED FROM A SOLUBLE PIGMENT PRECURSOR

This invention relates to an electrophotographic photoreceptor, the photosensitive layer of which contains, as the charge generating material, a fine organic pigment prepared from a soluble pigment precursor. No dispersion procedure is required for the fine organic pigment, so that excellent electrophotographic properties can be realized.

Electrophotographic photoreceptors employing mainly inorganic materials such as selenium, zinc oxide and cadmium sulfate have so far widely been used. However, such inorganic photoreceptors do not fully satisfy today's high performance requirements, such as high photosensitivity, heat stability, humidity resistance and durability.

In order to overcome the problems inherent in such inorganic photoreceptors, electrophotographic photoreceptors employing organic pigments have been developed, and vadous organic pigments, for example, azo compounds, perylene compounds, polycyclic quinone compounds, quinacridone compounds, and various structures of indigoid pigments have been employed as the organic charge generating materials (JP Kokai Sho 54-139540, 56-4148, 56-119131, 63-63046, 63-95455 and Hei 1-109352; U.S. Pat. Nos. 3,839,034, 4,220,697, 4,302,521, 4,431,722 and 4,952,472; DE patents No. 2237680 and 2948790 etc.).

In the electrophotographic photoreceptor, the grain size of the organic pigment is of great significance with respect to electrophotography, and it is necessary that the organic pigment particles are very tiny and finely dispersed. Thus, the prior art technique is to disperse the organic pigment powder by milling over a long time. However, according to such prior art technique, sufficiently fine grain size cannot be obtained without the dispersion stability getting poor, so that the resulting pigment powders are not sufficiently satisfactory for use in high quality electrophotographic photoreceptors.

It has now surprisingly been found that electrophotographic photoreceptors with excellent properties, containing well distributed very fine pigment particles, can be obtained by using pigment precursors.

The photosensitive layer of the instant electrophotographic photoreceptor contains minute organic pigment particles which are formed by a chemical reaction from a soluble pigment precursor without being necessarily subjected to a dispersion procedure.

This invention is directed to an electrophotographic photoreceptor comprising a conductive substrate and a photosensitive layer containing an organic pigment as a charge generating material, wherein said organic pigment is formed from a soluble organic pigment precursor. Preferably, the organic pigment is formed from the soluble organic pigment precursor within the photosensitive layer composition already applied onto the conductive substrate.

This invention is also directed to a method of preparation of an electrophotographic photoreceptor comprising a conductive substrate and a photosensitive layer containing an organic pigment as a charge generating material, comprising the steps of (1) forming a layer containing a soluble organic pigment precursor on the conductive substrate; and (2) regenerating said charge generating organic pigment chemically from the soluble organic pigment precursor.

Soluble pigment precursors are known substances. They consist of a chromophore residue which is substituted by 1 to 5 solubilizing groups which can be split off chemically, upon which splitting step the unsubstituted chromophore is regenerated in insoluble (pigmentary) form. The chemical reaction of the soluble organic pigment precursor to the regenerated charge generating organic pigment can be performed by known methods such as thermal, chemical or photochemical means or a combination thereof. Most appropriate is a thermal treatment, alone or in combination with a chemical agent such as for example an acid.

A particularly suitable soluble pigment precursor is a compound of formula (I), $$A(D_1)(D_2)_x \qquad (I)$$

or a derivative thereof, wherein x is an integer from 0 to 4;

A represents a chromophore residue which is a perylene, a quinacridone, an azo compound, an anthraquinone, a phthalocyanine, a dioxazine, an isoindolinone, an isoindoline, an indigo, a quinophthalone or a pyrrolopyrrole, and has from 1 to 5N atoms bound to the $D_1$ and to the x $D_2$ groups, whereby each N atom of A is independently from the other bound to 0, 1 or 2 groups $D_1$ or $D_2$;

$D_1$ and $D_2$ are independently a group represented by the formula (IIa), (IIb), (IIc) or (IId);

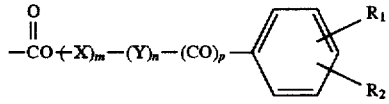
(IIa)

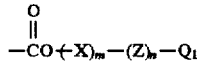
(IIb)

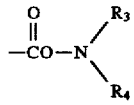
(IIc)

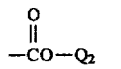
(IId)

wherein m, n and p are independently of each other 0 or 1;

X is a $C_1$–$C_{14}$ alkylene group or a $C_2$–$C_8$ alkenylene group;

Y is a group $-T_1-(CH_2)_q-$, wherein q is an integer of 1 to 6 and $T_1$ is a $C_3$–$C_6$ cycloalkylene group;

Z is a group $-T_1-(CH_2)_r-$, wherein r is an integer of 0 to 6 and $T_1$ has the same meaning as described above;

$R_1$ and $R_2$ represent independently of each other a hydrogen atom, a $C_1$–$C_6$ alkyl group, a $C_1$–$C_4$ alkoxy group, a halogen atom, a cyano group, a nitro group, or a phenyl or phenoxy group which may be substituted with $C_1$–$C_4$ alkyl, $C_1$–$C_4$ alkoxy or halogen;

$R_3$ and $R_4$ independently of each other represent a hydrogen atom, a $C_1$–$C_{18}$ alkyl group or a group of the formula

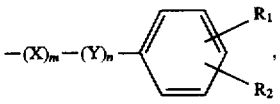

wherein X, Y, $R_1$, $R_2$, m and n have the same meanings as defined above; or $R_3$ and $R_4$ form together with the N atom to which they are attached a pyrrolidinyl group, a piperidinyl group or a morpholinyl group;

$Q_1$ represents a hydrogen atom, a cyano group, a group $Si(R_1)_3$, a group $—(R_5)(R_6)(R_7)$ wherein $R_5$ is halogen and $R_6$ and $R_7$ are independently hydrogen or halogen, a group

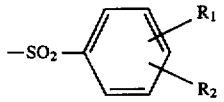

wherein $R_1$ and $R_2$ have the same meaning as described above, a group $—SO_2R_8$ or $—SR_8$ wherein $R_8$ is $C_1$–$C_4$ alkyl; a group $—CH(R_9)_2$ wherein $R_9$ is a phenyl or phenoxy group which may be substituted with $C_1$–$C_4$ alkyl, $C_1$–$C_4$ alkoxy or halogen, or a group of formula

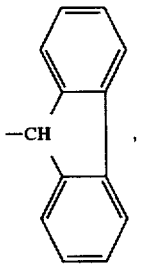

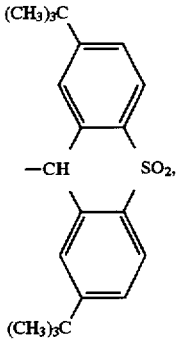

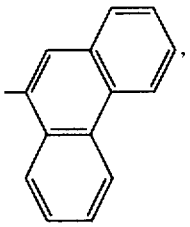

-continued

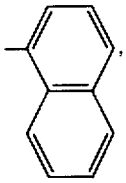

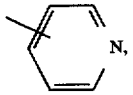

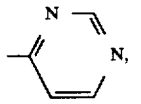

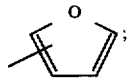

$Q_2$ represents a group of formula

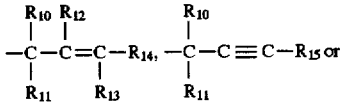

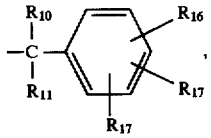

wherein $R_{10}$ and $R_{11}$ are independently hydrogen, $C_1$–$C_{24}$ alkyl, $C_1$–$C_{24}$ alkyl the chain of which is interrupted through O, S or $NR_{18}$, $C_3$–$C_{24}$ alkenyl, $C_3$–$C_{24}$ alkinil, $C_4$–$C_{12}$ cycloalkyl, $C_4$–$C_{12}$ cycloalkenyl, phenyl or biphenyl which is unsubstituted or substituted through $C_1$–$C_6$ alkyl, $C_1$–$C_6$ alkoxy, halogen, cyano or nitro;

$R_{12}$, $R_{13}$ and $R_{14}$ are independently hydrogen, $C_1$–$C_{24}$ alkyl or $C_3$–$C_{24}$ alkenyl; $R_{15}$ is hydrogen, $C_1$–$C_{24}$ alkyl, $C_3$–$C_{24}$ alkenyl or a group of formula

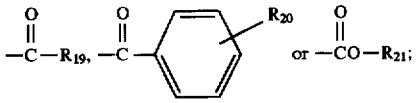

$R_{16}$ and $R_{17}$ are independently hydrogen, $C_1$–$C_6$ alkyl, $C_1$–$C_6$ alkoxy, halogen, cyano, nitro, $N(R_{18})(R_{19})$, phenyl which is unsubstituted or substituted through halogen, cyano, nitro, $C_1$–$C_6$ alkyl or $C_1$–$C_6$ alkoxy;

$R_{18}$ and $R_{19}$ are independently $C_1$–$C_6$ alkyl;

$R_{20}$ is hydrogen or $C_1$–$C_6$ alkyl; and $R_{21}$ is hydrogen, $C_1$–$C_6$ alkyl or phenyl which is unsubstituted or substituted through $C_1$–$C_6$ alkyl.

Preferably, each N atom of the chromophore residue A which is bound to a group $D_1$ or $D_2$ is adjacent to or conjugated with at least one carbonyl group. It is not necessary, and often not indicated, that all N atoms of the chromophore residue is bound to groups $D_1$ or $D_2$; on the contrary, $A(D_1)(D_2)_x$ may contain additional

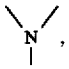

=N—, —NH— or —$NH_2$ groups.

Conversely, more than one group $D_1$ or $D_2$ may be bound to a single N atom; when for example the chromophore contains a group —$NH_2$, one or two groups $D_1$ or $D_2$ may be attached thereto, so that the residue A may be represented by &—NH· or by &—N·.

The A group is a chromophore residue of a known organic pigment having a backbone structure of $A(H)(H)_x$, such as for example

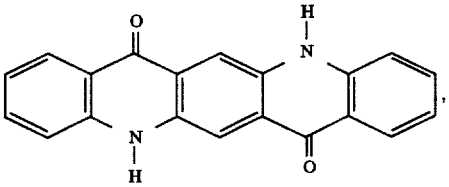

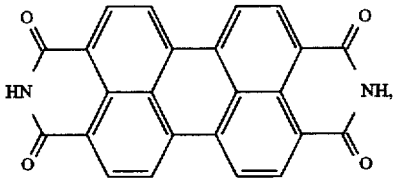

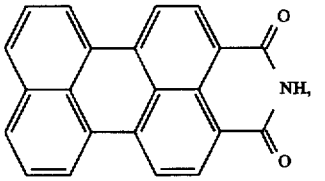

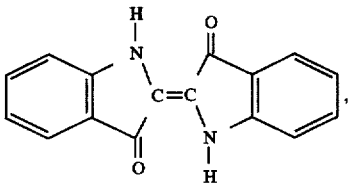

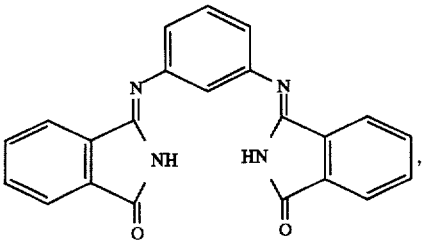

-continued

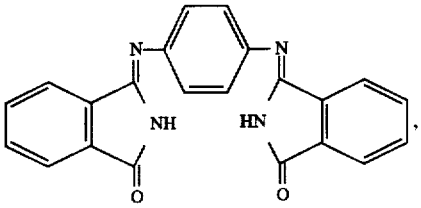

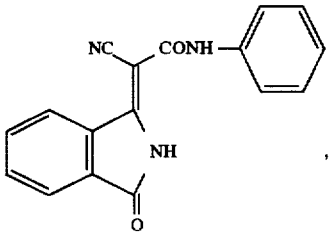

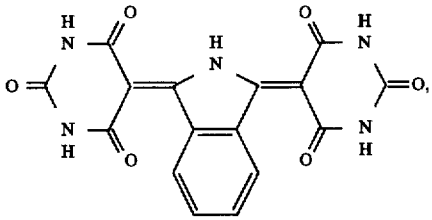

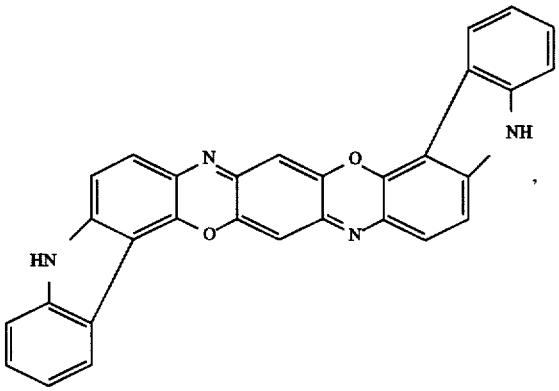

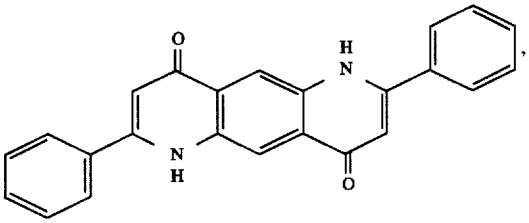

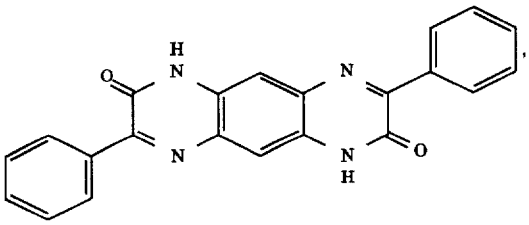

-continued

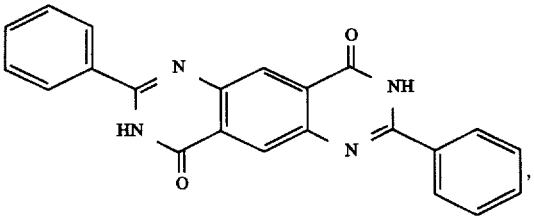

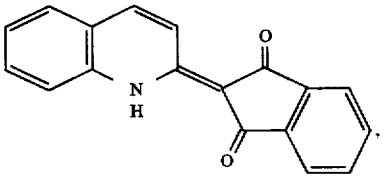

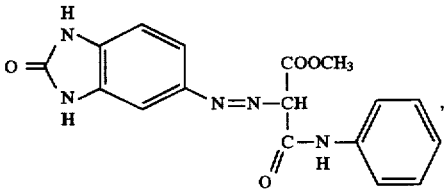

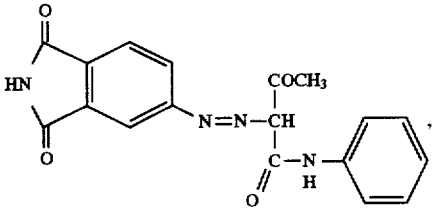

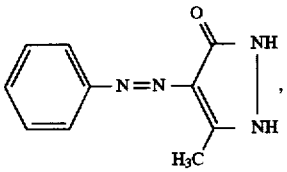

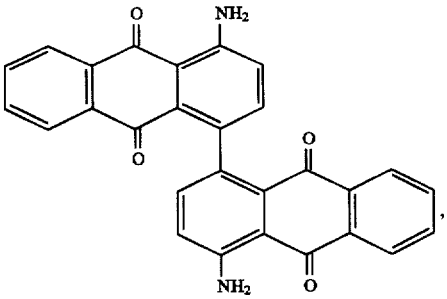

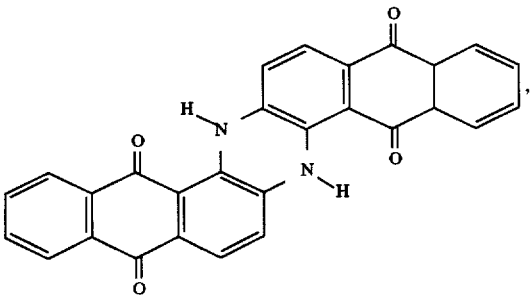

-continued

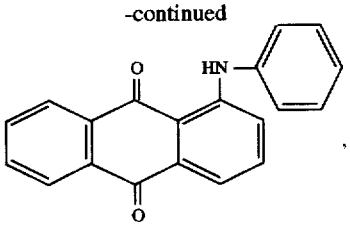

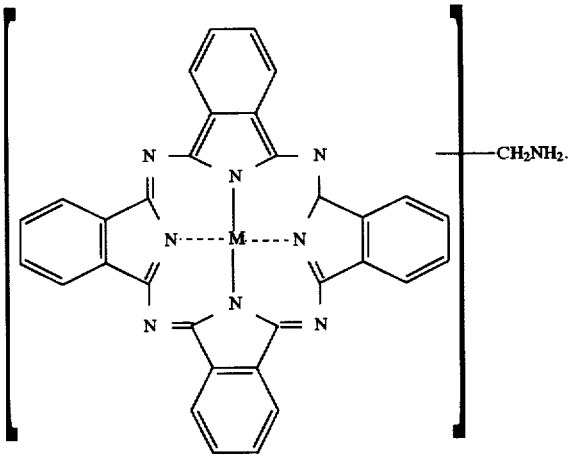

wherein M is for example $H_2$, Mg, Ca, Ti, V, Mn, Fe, Co, Ni, Cu, Zn, Zr, Pd, Cd, Sn, Ce, Hg, Pb or Bi, or

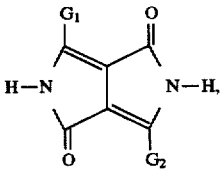

wherein $G_1$ and $G_2$ are for example independently from each other, a group

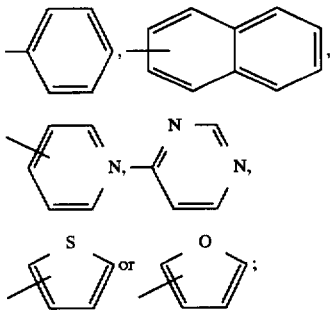

or any known derivative thereof, such as for example compounds wherein the chromophore's aryl groups are substituted, for instance with alkyl, alkoxy, alkylthio, dialkylamino, cyano, nitro, halogeno, acetyl, benzoyl, carboxy or carbamoyl groups.

The $C_1$–$C_4$ alkylene group X in formula (IIa) or (IIb) may be a linear or branched alkylene group, such as for example methylene, dimethylene, trimethylene, 1-methylmethylene, 1,1-dimethylmethylene, 1,1-dimethyldimethylene, 1,1-dimethyltdmethylene, 1-ethyl-dimethylene, 1-ethyl-1-methyldimethylene, tetramethylene, 1,1-dimethyltetramethylene, 2,2-dimethyltrimethylene, hexamethylene, decamethylene, 1,1-dimethyldecamethylene, 1,1-diethyldecamethylene and tetradecamethylene.

The $C_2$–$C_8$ alkylene group as X in the group of the formula (IIa) or (IIb) may be a linear or branched alkenylene group, such as for example vinylene, arylene, metharylene, 1-methyl-2-butenylene, 1,1-dimethyl-3-butenylene, 2-butenylene, 2-hexenylene, 3-hexenylene and 2-octenylene.

Halogen as a substituent may be chloro, bromo, iodo or fluoro, and is preferably bromo or chloro, most preferably chloro.

The $C_1$–$C_6$ alkyl groups include, for example, methyl, ethyl, n-propyl, isopropyl, n-butyl, s-butyl, t-butyl, n-amyl, t-amyl and hexyl. The $C_1$–$C_{18}$ alkyl groups include, for example, in addition to such $C_1$–$C_6$ alkyl groups, heptyl, octyl, 2-ethylhexyl, nonyl, decyl, dodecyl, tetradecyl, hexadecyl and octadecyl.

The $C_1$–$C_4$ alkoxy groups include, for example, methoxy, ethoxy, n-propoxy, isopropoxy and butoxy.

The $C_3$–$C_6$ cycloalkylene groups includes, for example, cyclopropylene and cyclopentylene, preferably cyclohexylene.

In a particularly preferable compound of the formula (I), x is 0 or 1; and $D_1$ and $D_2$ represent groups of formula (IIIa), (IIIb), (IIIc) or (IIId),

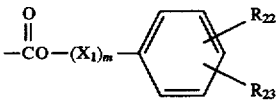
(IIIa)

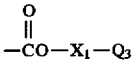
(IIIb)

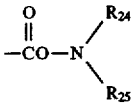
(IIIc)

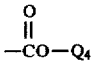
(IIId)

wherein m is 0 or 1; $X_1$ is a $C_1$–$C_4$ alkylene group or a $C_2$–$C_5$ alkenylene group;

$R_{22}$ and $R_{23}$ are independently of each other hydrogen, $C_1$–$C_4$ alkyl, methoxy, chloro or nitro;

$Q_3$ is hydrogen, cyano, trichloromethyl,

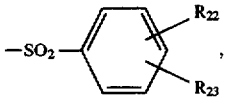

$SO_2CH_3$ or $SCH_3$;

$R_{24}$ and $R_{25}$ are independently of each other hydrogen, $C_1$–$C_4$ alkyl or

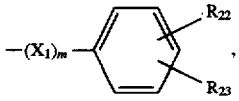

or $R_{24}$ and $R_{25}$ form together with the N atom to which they are attached a piperidinyl group;

and $Q_4$ is

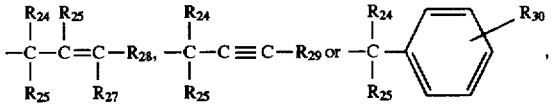

wherein $R_{24}$to $R_{28}$ are independently from each other hydrogen or $C_1$–$C_{12}$ alkyl;

$R_{29}$ is hydrogen, $C_1$–$C_{12}$ alkyl,

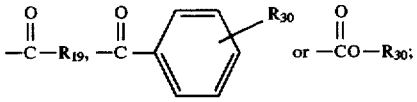

and $R_{30}$ is hydrogen or $C_1$–$C_4$ alkyl.

Most preferably, in formula (I) x is 1 and $D_1$ and $D_2$ are identical groups

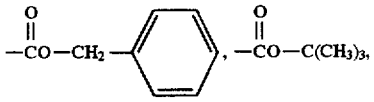

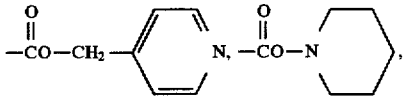

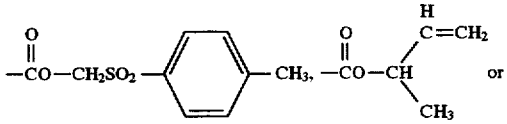

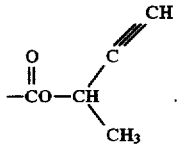

Preferred compounds of formula (I) are:

(a) a perylenecarboxyimide represented by the formula (IVa) or (IVb),

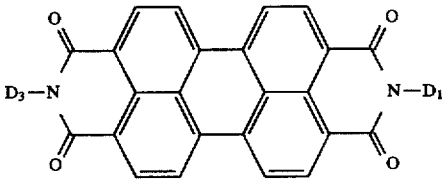
(IVa)

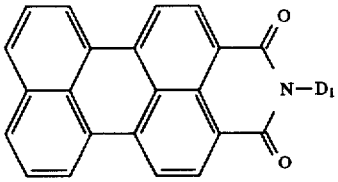
(IVb)

wherein $D_3$ represents a hydrogen atom, $C_1$–$C_6$ alkyl group, a phenyl, benzyl or phenethyl group which is unsubstituted or substituted with halogen or $C_1$–$C_4$ alkyl, or a group $D_1$;

(b) a quinacridone represented by the formula (V),

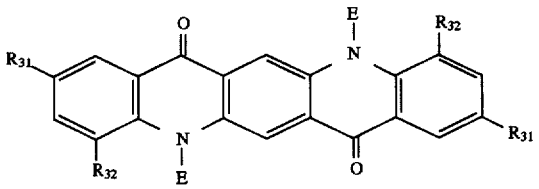

(V)

wherein $R_{31}$ and $R_{32}$ independently of each other represent a hydrogen atom, a halogen atom, a $C_1$–$C_{18}$ alkyl group, a $C_1$–$C_4$ alkoxy group or a phenyl group; and E represents a hydrogen atom or a group $D_1$, provided that at least one E is a group $D_1$;

(c) a dioxazine represented by the formula (VI),

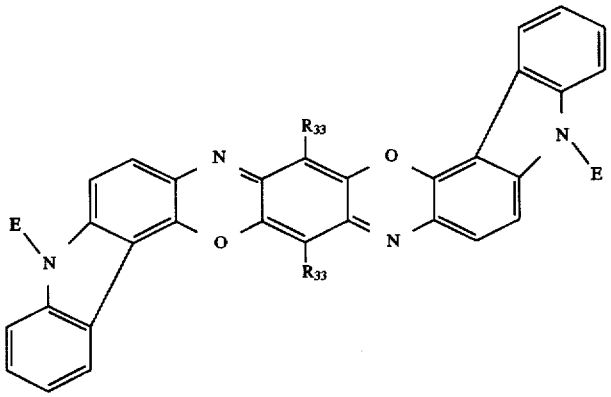

(VI)

wherein $R_{33}$ represents a hydrogen atom, a halogen atom or a $C_1$–$C_{18}$ alkyl group; and E represents a hydrogen atom or a group $D_1$, provided that at least one E is a group $D_1$;

(d) an isoindoline represented by the formula (VIIa), (VIIb) or (VIIc),

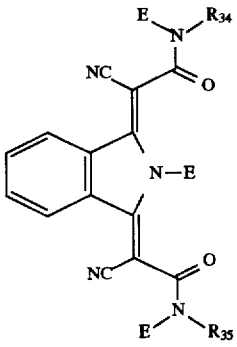

(VIIa)

-continued

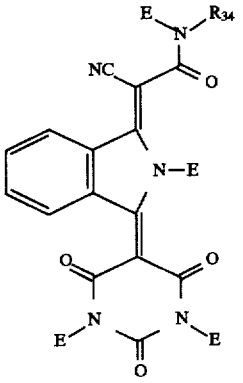

(VIIb)

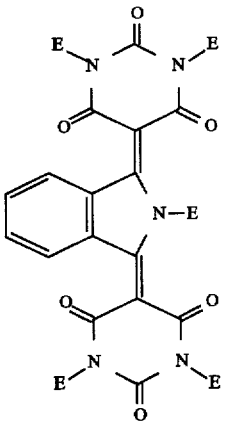

(VIIc)

-continued wherein $R_{34}$ represents a group of the formula

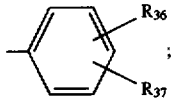

$R_{35}$ represents a hydrogen atom, a $C_1$–$C_{18}$ alkyl group, a benzyl group or a group of the formula;

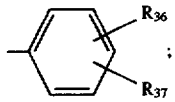

$R_{36}$ and $R_{37}$ represent independently of each other a hydrogen atom, a $C_1$–$C_{18}$ alkyl group, a $C_1$–$C_4$ alkoxy group, a halogen atom or a trifluoromethyl group; and E represents a hydrogen atom or a group $D_1$, provided that at least one E is a group $D_1$;

(e) an indigo represented by the formula (VIII),

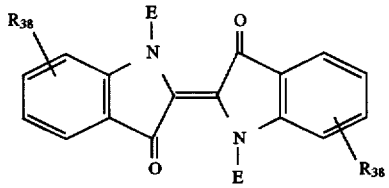

(VIII)

wherein $R_{38}$ represents a hydrogen atom, a cyano group, a $C_1$–$C_4$ alkyl group, a $C_1$–$C_4$ alkoxy group or a halogen atom; and E represents a hydrogen atom or a group $D_1$, provided that at least one E is a group $D_1$;

(f) an azobenzimidazolone represented by the formula (IX),

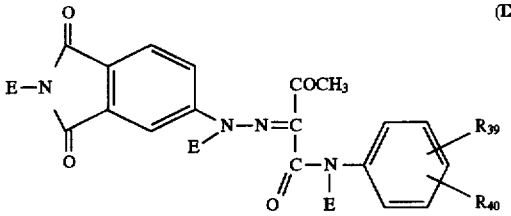

(IX)

wherein $R_{39}$ and $R_{40}$ independently of each other represent a hydrogen atom, a halogen atom, a $C_1$–$C_4$ alkyl group or a $C_1$–$C_4$ alkoxy group; and E represents a hydrogen atom or a group $D_1$, provided that at least one E is a group $D_1$;

(g) an anthraquinoid compound represented by the formula (X),

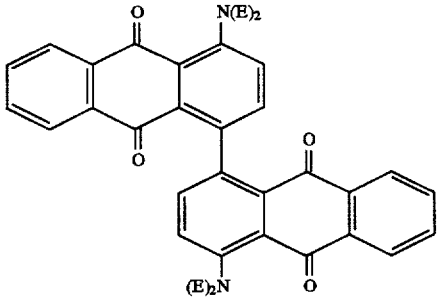

(X)

wherein E represents a hydrogen atom or a group $D_1$, provided that at least one E is a group $D_1$;

(h) a phthalocyanine represented by the formula (XI),

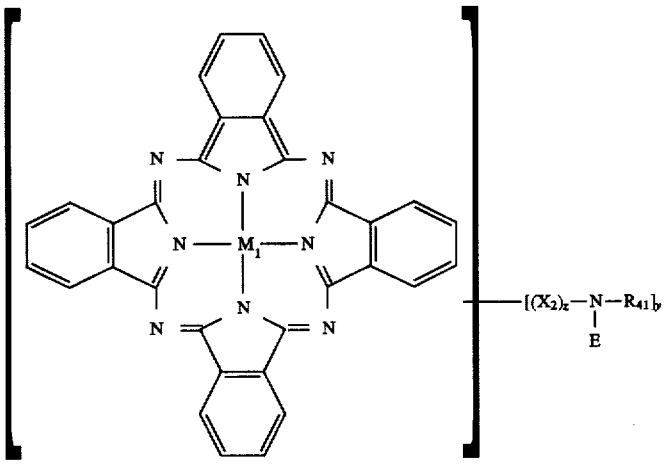

(XI)

wherein $M_1$ represents $H_2$, Zn, Cu, Ni, Fe, Ti(O) or V(O); $X_2$ represents —CH($R_{42}$)— or $SO_2$; and $R_{41}$ represents a hydrogen atom, a $C_1$–$C_4$ alkyl group, N(E)$R_{42}$, —NHCO$R_{43}$, —CO$R_{43}$ or a group of the formula

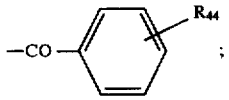

$R_{42}$ represents a hydrogen atom or a $C_1$–$C_4$ alkyl group; $R_{43}$ represents a $C_1$–$C_4$ alkyl group; $R_{44}$ represents a hydrogen atom, a halogen atom, a $C_1$–$C_4$ alkoxy group; z is 0 or 1; y is an integer of 1 to 4; and E represents a hydrogen atom or a group $D_1$, provided that at least one E is a group $D_1$;

(i) a pyrrolo[3,4-c]pyrrole represented by the formula (XII),

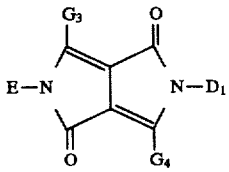

(XII)

wherein $G_3$ and $G_4$ independently of each other represent a group of the formula

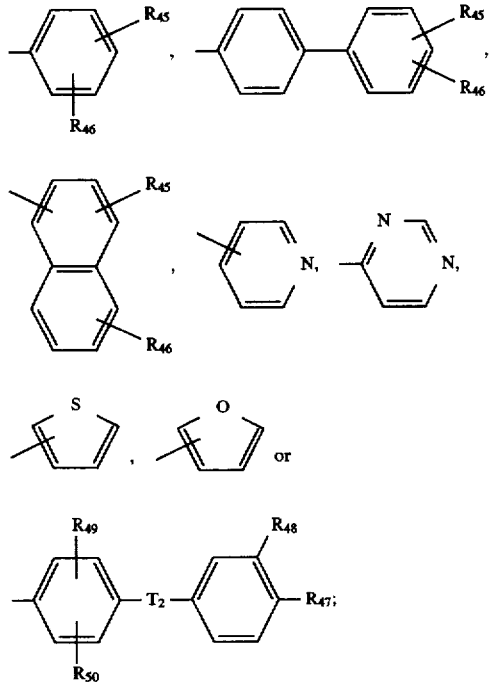

$R_{45}$ and $R_{46}$ independently of each other represent hydrogen, halogen, $C_1$–$C_{18}$ alkyl, $C_1$–$C_{18}$ alkoxy, $C_1$–$C_{18}$ alkylmercapto, $C_1$–$C_{18}$ alkylamino, cyano, nitro, phenyl, trifluoromethyl, $C_5$–$C_6$ cycloalkyl, —CH=N—($C_1$–$C_{18}$alkyl),

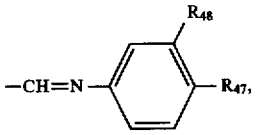

imidazolyl, pyrazolyl, triazolyl, piperazinyl, pyrrolyl, oxazolyl, benzoxazolyl, benzothiazolyl, benzoimidazolyl, morpholinyl, piperidinyl or pyrrolidinyl; $T_2$ represents —$CH_2$—, —CH($CH_3$)—, —$(CH_3)_2$—, —CH=N—, —N=N—, —O—, —S—, —SO—, —$SO_2$— or —$NR_{51}$—; $R_{47}$ and $R_{48}$ represent independently of each other hydrogen, halogen, $C_1$–$C_6$ alkyl, $C_1$–$C_{18}$ alkoxy or cyano; $R_{49}$ and $R_{50}$ represent independently of each other hydrogen, halogen or $C_1$–$C_6$ alkyl; $R_{51}$ represents hydrogen or $C_1$–$C_6$ alkyl; E represents a hydrogen atom or a group $D_1$, provided that at least one E is a group $D_1$; or (j) an isoindolinone represented by the formula (XIIIa) or (XIIIb),

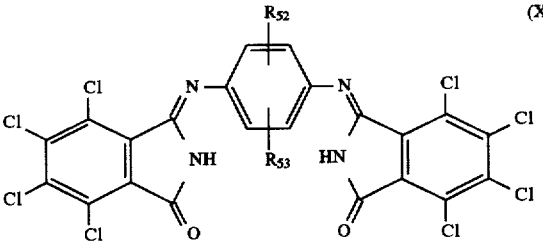

(XIIIa)

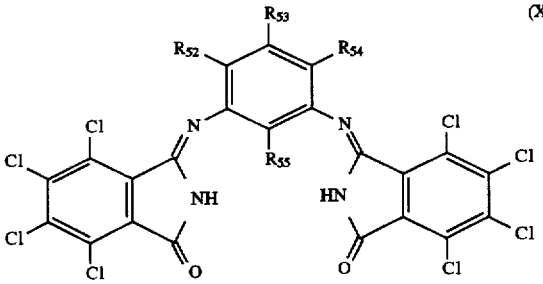

(XIIIb)

wherein $R_{52}$, $R_{53}$, $R_{54}$ and $R_{55}$ are each independently of the other hydrogen, $C_1$–$C_{18}$-alkyl, $C_1$–$C_4$-alkoxy, halogen or trifluoromethyl.

Preferred of the phthalocyanines of formula (XI) is a compound, wherein $M_1$ is $H_2$, Cu or Zn; $X_2$ is —$CH_2$— or —$SO_2$—; $R_{41}$ is a hydrogen atom, —NHCO$CH_3$ or a benzoyl group; and z is 1.

In a preferred pyrrolo[3,4c]pyrrole compound of formula (XII), $G_3$ and $G_4$ represent independently of each other a group of the formula

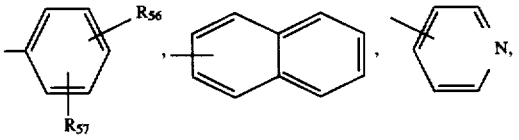

-continued

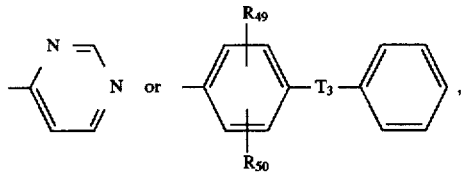

wherein $R_{56}$ and $R_{57}$ represent independently of each other hydrogen, chlorine, bromine, $C_1$–$C_4$ alkyl, $C_1$–$C_6$ alkoxy, $C_1$–$C_6$ alkylamino, cyano or phenyl; and $T_3$ represents —O—, —NH—, —N($CH_3$)—, —N($C_2H_5$)—, —N=N— or —$SO_2$—.

In the most preferred pyrrolo[3,4c]pyrrole compounds of formula (XII), $G_3$ and $G_4$ each represent a group of the formula

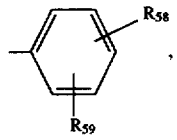

wherein $R_{58}$ and $R_{59}$ represent independently of each other hydrogen, methyl, tert.-butyl, chlorine, bromine, cyano or phenyl.

The choice of the pigment precursor's type for use in the present invention is however not essential for obtaining the desired result, which is an electrophotographic photosensitive layer containing very tiny and finely dispersed organic pigment particles. Expendiently, the chromophore A is chosen as a function of its stability and photoelectrical properties, and the attached groups $D_1$ and $D_2$ are chosen in order for the pigment precursor to be stable at room temperature and to be able to regenerate the pigment readily under mild conditions, such as for example at temperatures from 50° to 200° C. and acid concentrations from 0 to 0.1 mol/l. However, harsher regeneration conditions usually do not harm the pigments. The pigment precursors of formulae (IVa), (IVb), (V), (VI), (VIIa), (VIIb), (VIIc), (VIII), (IX), (X), (XI), (XII), (XIIIa) and (XIIIb) meet particularly well the above wishes.

The choice of pigment precursors is nevertheless not limited to those of formula (I). On the contrary, any known pigment precursor which decomposes to a pigment under thermal, chemical or photochemical conditions or a combination thereof is suitable for use in the present invention. Known such compounds are for example those of formula (XIV) below.

Accordingly, this invention is also directed to an electrophotographic photoreceptor comprising a conductive substrate and a photosensitive layer containing, as a charge generating material, an organic pigment formed via a pigment precursor which is a compound of formula (XIV), (XIV)

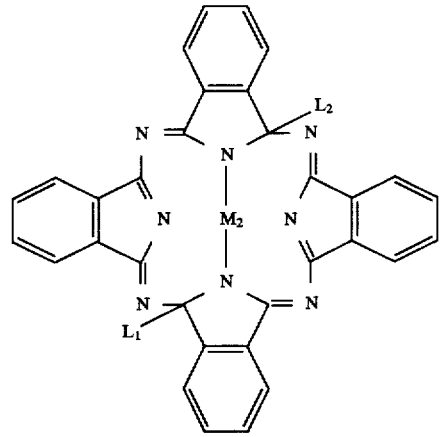

wherein $L_1$ and $L_2$ are independently from one other halogen, $C_1$–$C_{18}$ alkoxy, $C_2$–$C_{18}$ dialkylamino, $C_1$–$C_{18}$ cycloalkylamino, (N'-$C_1$–$C_6$alkyl)piperidino or morpholino, and $M_2$ stands for two hydrogens or a metal or oxometal with at least two valences; or a derivative thereof.

Preferred of the phthalocyanines of formula (XIV) is a compound, wherein $M_2$ is $H_2$, Zn, Cu, Ni, Fe, Ti(O) or V(O), and $L_1$ and $L_2$ are independently from one other $C_2$–$C_{18}$ dialkylamino, $C_1$–$C_{18}$ cycloalkylamino, (N'-$C_1$–$C_6$alkyl) piperidino or morpholino; or a derivative thereof where the phenyl groups are substituted by 1 to 16 bromo or chloro.

Particularly preferred is a phthalocyanine compound of formula (XIV), wherein $M_2$ is $H_2$, Zn or Cu, and both $L_1$ and $L_2$ are morpholino; or a derivative thereof wherein the phenyl groups are substituted by 4, 8, 12 or 16 chlorine atoms.

The pigment precursors of formula (I), and particularly those of formulae (IVa), (IVb), (V), (VI), (VIIa), VIIb), (VIIc), (VIII), (IX), (X), (XI), (XII), (XIIIa) and (XIIIb), can be prepared by reacting a pigment of formula $A(H)(H)_x$ (XIV) with a dicarbonate, trihaloacetate, azide, carbonate or alkylidene-iminoxyformate at a desired molar ratio in the presence of a polar organic solvent and a basic catalyst, as for example described in Angewandte Chemie 68/4, 133–150 (1956), J. Org. Chem. 22, 127–132 (1957), EP-648770 or EP-648817.

The pigment precursors of formula (XIV) can be prepared as described by F. Baumann et al. [Angew. Chem. 68, 133–168 (1956) and U.S. Pat. No. 2,683,643] and by C. J. Pedersen [J. Org. Chem. 22, 127–132 (1957), U.S. Pat. No. 2,662,895, U.S. Pat. No. 2,662,896 and U.S. Pat. No. 2,662,897].

Pigments of relatively course particle size are also suitable as a starting material for the above mentioned preparation of pigment precursors. A milling step is usually not required.

The pigment precursors of formulae (I) or (XIV) are soluble in common organic solvents such as for example an ether solvent like tetrahydrofuran and dioxane; a glycol ether solvent like ethylene glycol methyl ether, ethylene glycol ether, diethylene glycol monomethyl ether or diethylene glycol monomethyl ether; an amphoteric solvent like acetonitrile, benzonitrile, N,N-dimethylformamide, N,N-dimethylacetamide, nitrobenzene or N-methylpyrrolidone; a halogenated aliphatic hydrocarbon solvent like trichloroethane; an aromatic hydrocarbon solvent like benzene, toluene, xylene, anisole or chlorobenzene; and a N-containing aromatic heterocyclic solvent like pyridine, picoline and quinoline. Preferred solvents are tetrahydrofuran (THF), N-N-dimethylformamide and N-methylpyrrolidone.

The pigment precursor (I) or (XIV) can easily be converted back to the pigment by known methods such as those mentioned in EP-648770 or EP-648817. Preferred methods are (a) heating to 50° to 150° C. together with an inorganic acid or an organic acid, and then cooling to 30° C. or lower;, or (b) heating to 120° to 350° C. in the absence of an acid.

Upon treatment (a) or (b), the substituents $D_1$ and if applicable $D_2$ in formula (I) or the substituents $L_1$ and $L_2$ in formula (XIV) are eliminated and the original pigment is regenerated as discemible from the development of its characteristic color.

The pigment precursors (I) and (XIV) have good compatibility with various resins.

Accordingly, a single or double-layer electrophotographic photoreceptor can be prepared using a pigment precursor (I) or (XIV) as follows:

(1) Electrophotographic photoreceptor with double-layered photosensitive layer:

A composition prepared by dissolving a pigment precursor of formula (I) or (XIV) in an organic solvent, and dispersing therein, as a binder, a resin such as polycarbonate, polyvinyl butyral, polyurethane, epoxy resin, silicone resin, polyvinyl formal, acrylic resin, poly-N-vinylcarbazole and polyvinylpyrrolidone is applied on a conductive substrate to a thickness of 0.05 to 5 μm, followed by drying to prepare a film. Then, the obtained film is heated until the color change is completed, thus providing a charge generation layer (CGL) presenting the color of the original pigment. Subsequently, a charge transportation layer (CTL) including a charge transporting material such as N,N'-diphenyl-N,N'-bis(dimethylphenyl)-1,1'-biphenyl-4,4'-diamine, triphenylmethane, a stilbene derivative, an enamine derivative or a hydrazone derivative is provided onto the charge generation layer.

Alternatively, the photosensitive layer may be formed by arranging the charge generation layer above the charge transportation layer.

(2) Electrophotographic photoreceptor with single-layered photosensitive layer:

The pigment precursor of formula (I) or (XIV), the charge transporting material and the resin are dissolved in an organic solvent, and the resulting solution is applied onto a conductive substrate and dried to form a film. Then, the obtained film is heated until the color change is completed.

In both the single and double-layered cases, an undercoating layer may be formed between any two of the substrate, the photosensitive layer and the charge transportation layer, and a top protective layer may be formed on the photosensitive or the charge transportation layer.

Instead of being formed by a solvent coating process, the photosensitive layer (or other layers) may be applied onto the substrate by a laminating process. In this case, the laminating temperature is preferably chosen in order for the pigment to be formed during lamination, so that a subsequent heat or chemical treatment becomes superfluous.

As a conductive substrate for the present invention, any known conductive material may be used. As examples which are only illustrative and to which the scope of this invention is not limited, thin aluminum foil, or polycarbonate, polyester, polyamide, polypyrrole or polyacetylene films can be mentioned. Many other conductive substrates are well-known in the art and can be used, too.

Highly sensitive double-layered electrophotographic photoreceptors have only been prepared in the prior art by dividing pigments to fine particles by subjecting it to an extended milling procedure. Moreover, the prior art's single-layered electrophotographic photoreceptors in which a pigment is finely and homogeneously dispersed have been very difficult to prepare.

The present invention provides the means for preparing either double-layered or single-layered electrophotographic photoreceptors of improved sensitivity and reduced residual electric potential, wherein the pigment is excellently fine-sized and very homogeneously dispersed, in a much simpler and better reproducible way. The instant electrophotographic photoreceptor, wherein the charge generating organic pigment is formed from a soluble organic pigment precursor, is therefore advantageously used in an electrophotographic process, such as for example implemented in a photocopying machine or a laser printer.

The present invention provides furthermore also the means for preparing reinstated pigments having excellent electrical properties for use in electrophotographic photoreceptors in a much shorter time than according to the prior art.

The following examples illustrate the invention:

A. Preparation of the Pigment Precursors

Example A1:

6.0 g (0.0275 mol) of di-t-butyl dicarbonate are added to a mixture of 1.8 g (0.00576 mol) of quinacridone and 0.3 g (0.00246 mol) of 4-dimethylaminopyridine in 90 ml of N,N-dimethylformamide. The resulting purple suspension is stirred at room temperature overnight under protection from atmospheric moisture. The color of the suspension turns to yellowish orange. Subsequently, the reaction mixture is poured into 100 ml of distilled water with stirring. The yellow precipitate is separated by filtration, and the residue is washed with distilled water and added to give 2.8 g of the compound of formula:

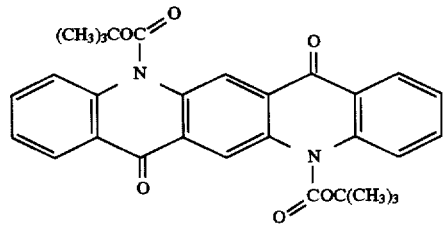

$^1$H-NMR ($CDCl_3$): 8.74 (s,2H); 8.41 (d,2H); 7.84 (d,2H); 7.72 (t,2H); 7.38 (t,2H) 1.75 (s,18H).

Example A2:

45.31 g (0.2076 mol) of di-t-butyl dicarbonate are added in two portions to a suspension of 10.31. g (0.0393 mol) of indigo and 2.79 g (0.0228 mol) of 4-dimethylaminopyridine in 150 ml of N,N-dimethylformamide. While the resulting mixture is stirred at room temperature for 20 hours, the color of the mixture turns from dark blue to purple. The product is separated by filtration, and the residue is washed first with 20 ml of dimethylformamide and then distilled water and added to give 9.79 g of a bright red solid of the formula:

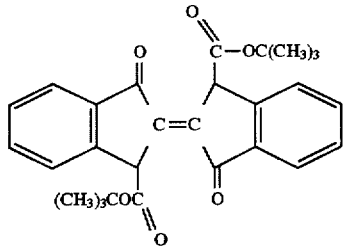

Additional 5.13 g of product are obtained by diluting the filtrate with distilled water. The total yield of the product is 14.93 g.

$^1$H-NMR ($CDCl_3$): 8.02 (d,2H); 7.76 (d,2H); 7.61 (t,2H); 7.21 (t,2H); 1.62 (s,18H).

Example A3:

0.18 g (0.00147 mol) of 4-dimethylaminopyridine is added to a solution of a mixture containing 1.5 g (0.00337 mol) of a pigment of the formula

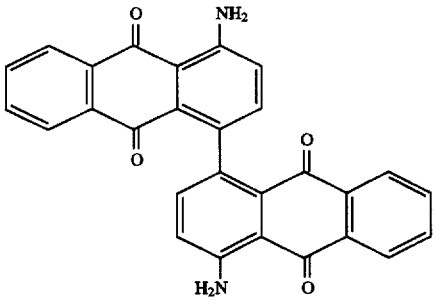

and 9.7 g (0.0444 mol) of di-t-butyl dicarbonate in 80 ml of N,N-dimethylacetamide. The resulting mixture is stirred at room temperature for 24 hours. The reaction mixture is poured into 200 ml of distilled water with stirring. The yellow precipitate thus formed is separated by filtration, and the residue is washed with distilled water and added at room temperature under reduced pressure to give 2.71 g (95% of the theoretical value) of a product having the formula:

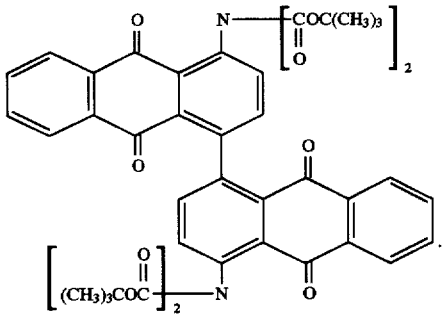

$^1$H-NMR ($CDCl_3$): 8.22 (d,2H); 7.83 (d,2H); 7.72 (t,2H); 7.63 (t,2H); 7.56 (d,2H); 7.42 (d,2H); 1.45 (s,36H).

Example A4:

0.2 g (0.00164 mol) of 4-dimethylaminopyridine is added to a mixture containing 1.4 g (0.0037 mol) of a monoazo pigment of the formula

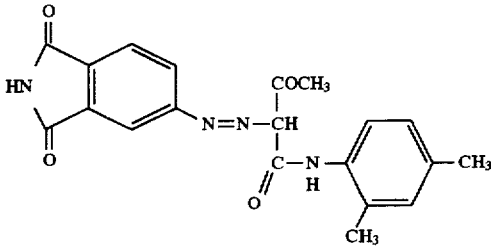

and 2.67 g (0.01221 mol) of di-t-butyl dicarbonate in 50 ml of N,N-dimethylacetamide. Upon stirring the reaction mixture at room temperature for 48 hours, an orange suspension is formed. The yellow precipitate is separated by filtration, and the residue is washed with a small amount of N,N-dimethylacetamide and then with distilled water and added at room temperature under reduced pressure to give 0.67 g (31% of the theoretical value) of product having the formula

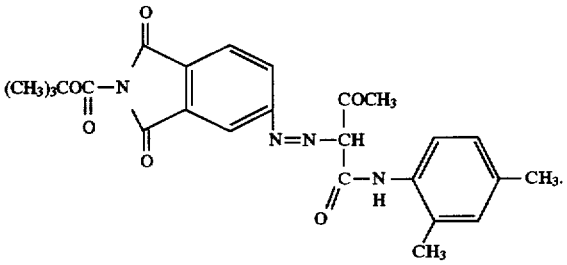

$^1$H-NMR ($CDCl_3$): 15.9 (s,br,1H); 11.17 (s,br,1H); 7.94 (d, 1H); 7.90 (d,1H); 7.85 (d,1H); 7.64 (d,1H); 7.06–7.04 (m,2H); 2.65 (s,3H); 2.35 (s,3H); 2.32 (s,3H); 1.64 (s,9H);

Examples A5 to A8:

The compounds of general formula:

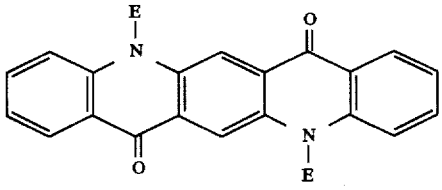

as listed below are prepared using corresponding dicarbonates, respectively, according to the general method described in Example A1.

| Example | E | Solvent | Reaction Time | Yield | Color |
|---|---|---|---|---|---|
| A5 | $-CO-C(CH_3)_2-CH_2CH_3$ | DMF | 30 h | 80% | yellowish orange |
| A6 | $-CO-C(CH_2CH_3)_2-CH_2CH_3$ | DMF | 24 h | 30% | yellowish orange |
| A7 | $-CO-C(CH_3)_2-CH_2-C_6H_5$ | DMF | 16 h | 80% | yellowish orange |
| A8 | $-CO-CH(CH_3)$ | DMF | 24 h | 35% | yellowish orange |

Example A9:

27.94 g (0.128 mol) of di-t-butyl dicarbonate are added in three portions over one hour to a mixture of 14.75 g (0.0512 mol) of 1,4-diketo-2,5-dihydro-3,6-diphenyl-pyrrolo-[3,4-c] pyrrole and 3.23 g (0.0264 mol) of 4-dimethylaminopyridine in 500 ml of tetrahydrofuran (dried over a molecular sieve). The resulting red suspension is stirred at room temperature for 2 hours under protection from atmospheric moisture and a dark green solution is obtained. The solvent is distilled off under reduced pressure. The yellow residue thus formed is washed with a 5% aqueous sodium hydrogencarbonate solution and then with water, and dried under reduced pressure to give 24.5 g (98% of the theoretical value) of the compound of formula:

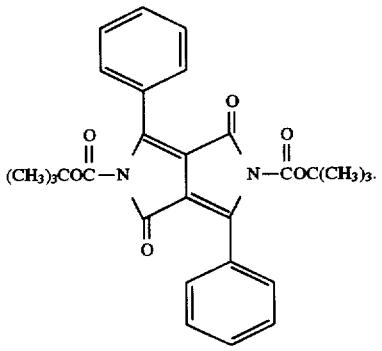

$^1$H-NMR ($CDCl_3$): 7.75 (d,4H); 7.48–7.50 (m,6H); 1.40 (s,18H).

Example A10:

Successively, 0.85 g (0.007 mol) of 4-dimethylaminopyridine and 6.55 g (0.030 mol) of di-t-butyl dicarbonate are added to a suspension of 4.29 g (0.012 mol) 1,4-diketo-3,6-bis(4-chlorophenyl)pyrrolo[3,4-c] pyrrole in 250 ml of N,N-dimethylformamide (dried over a molecular sieve). The resulting reaction mixture is stirred at room temperature under protection from atmospheric moisture. After 2 hours, further 6.55 g of di-t-butyl dicarbonate are added to the reaction mixture, and the stirring is continued for 72 hours. Subsequently, the reaction mixture is poured into 500 ml of distilled water while stirring well. The precipitated orange brown solid is isolated by filtration, and the residue is washed with cold distilled water and added at room temperature under reduced pressure to give 6.1 g (91% of the theoretical value) of the compound of formula

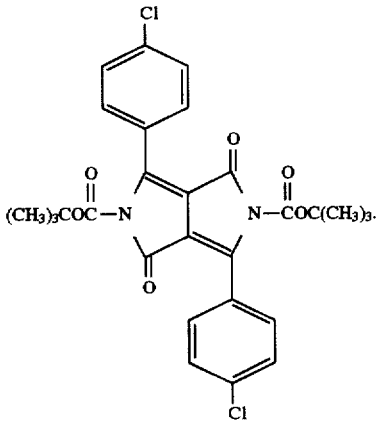

$^1$H-NMR ($CDCl_3$): 7.69 (d,4H); 7.46 (d,4H); 1.44 (s,18H).

Example A11:

24.29 g (0.111 mol) of di-t-butyl dicarbonate are added to a solution of a mixture containing 8.44 g (0.021 mol) of 1,4-diketo-2,5-dihydro-3,6-bis(4-t-butylphenyl)-pyrrolo[3,4-c]pyrrole and 1.49 g (0.0012 mol) of 4-dimethylaminopyridine in 100 ml of N,N-dimethylformamide dried over a molecular sieve). When the resulting red suspension is stirred at room temperature for 3 hours under protection from atmospheric moisture, the color of the suspension changes to orange. The precipitated solid is isolated by filtration, and the residue is washed many times with cold distilled water and added at room temperature under reduced pressure to give 11.40 g (90% of the theoretical value) of the bright yellow solid of formula:

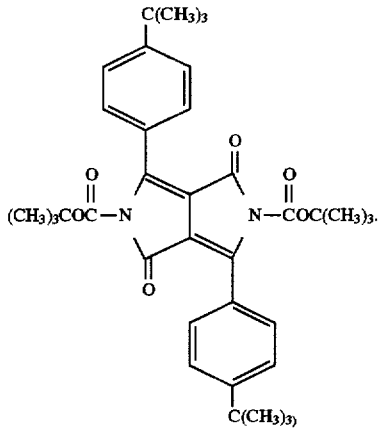

$^1$H-NMR ($CDCl_3$): 7.69 (d,4H); 7.48 (d,4H); 1.43 (s,18H); 1.34 (s,18H).

Examples A12 to A20:

According to the general method described in Examples A9 to A11, 2,5-dihydro-pyrrolo[3,4-c]pyrrole derivatives of formula

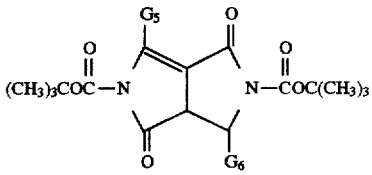

are prepared from the corresponding compounds of formula

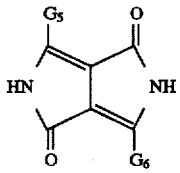

| Example | $G_5$ | $G_6$ | Solvent | Reaction time | Yield | $^1$H-NMR ($CDCl_3$) |
|---|---|---|---|---|---|---|
| A12 | 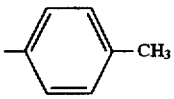 | 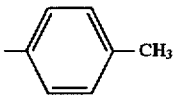 | THF | 16 | 94% | 7.65(d, 4H); 7.28(d, 4H); 2.42(s, 6H); 1.43(s, 18H) |
| A13 | 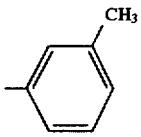 | 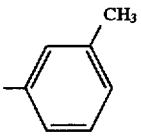 | DMF | 4 | 92% | 7.54–7.57(m, 4H); 7.29–7.39(m, 4H); 2.41(s, 6H); 1.39(s, 18H) |
| A14 | 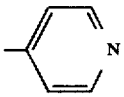 | 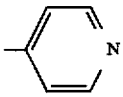 | DMF | 20 | 45% | 8.78(d, 4H); 7.56(d, 4H); 1.44(s, 18H) |
| A15 | 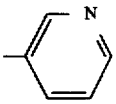 | 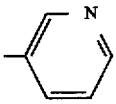 | DMF | 28 | 65% | 8.81(s, 2H); 8.72(d, 2H); 8.19(d, 2H); 7.47(dd, 2H); 1.44(s, 18H) |
| A16 | 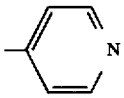 | 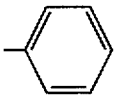 | DMF | 20 | 20% | 8.82(d, 2H); 8.51(d, 2H); 8.31(d, 2H); 7.60–7.63 (m, 3H); 1.39(s, 18H) |
| A17 | 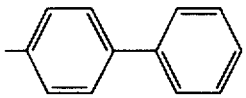 | 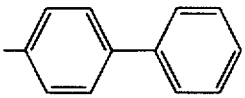 | DMF | 28 | 90% | 7.86(d, 4H); 7.72(d, 4H); 7.65(d, 4H); 7.48(t, 4H); 7.40(t, 2H); 1.46(s, 18H) |
| A18 | 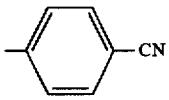 | 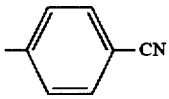 | DMF | 17 | 57% | 7.77–7.84(m, 8H); 1.45 (s, 18H) |

-continued

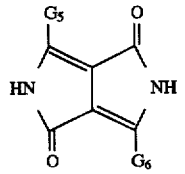

| Example | $G_5$ | $G_6$ | Solvent | Reaction time | Yield | $^1$H-NMR ($CDCl_3$) |
|---|---|---|---|---|---|---|
| A19 | 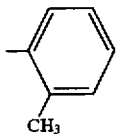 | 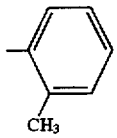 | THF | 6 | 28% | 7.42–7.25(m, 8H)2.48(s, 3H); 2.41(s, 3H); 1.25 (s, 18H) |
| A20 | 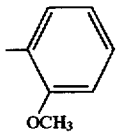 | 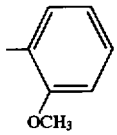 | THF | 6 | 60% | 7.80(d, 2H); 7.45(t, 2H); 7.09(t, 2H); 6.89(d, 2H); 3.90(s, 6H); 1.34(s, 18H) |

Examples A21 to A24:

Similarly to the method described in Examples A9 to A11, the compounds of formula

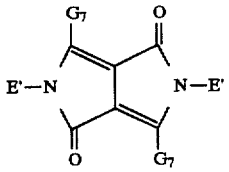

are prepared using the respective corresponding dicarbonates.

| Example | $G_7$ | E' | Solvent | Reaction time | Yield | $^1$H-NMR ($CDCl_3$) |
|---|---|---|---|---|---|---|
| A21 | 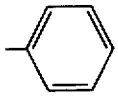 | 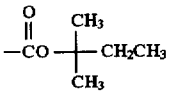 | THF | 24 | 80% | 7.71–7.78(m, 4H); 7.46–7.52(m, 6H); 1.61–1.71 (q, 4H); 1.1(s, 12H); 0.74–0.82(c, 6H) |
| A22 | 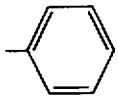 | 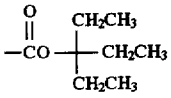 | THF | 15 | 30% | 7.71–7.78(m, 4H); 7.42–7.50(m, 6H); 1.78–1.92 (q, 12H); 0.75–0.90(t, 18H) |
| A23 | 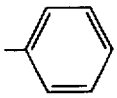 | 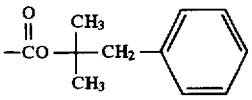 | THF | 3 | 92% | 7.70–7.78(m, 4H); 7.42–7.51(m, 6H); 7.22–7.38 (m, 6H); 7.08–7.12(m, 4H); 2.98(s, 4H); 1.41(s, 12H) |
| A24 | 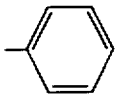 | 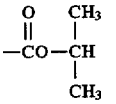 | THF | 24 | 36% | 7.68–7.78(m, 4H); 7.46–7.52(m, 6H); 5.00–5.10 (sept., 2H); 1.22(d, 12H) |

Example A25:

The procedure of Example A9 is repeated analogously, except that di-t-butyl dicarbonate is replaced by an equivalent amount of diethyl dicarbonate to give the pyrrolo[3,4-c]pyrrole of formula

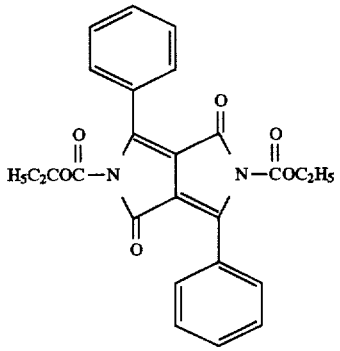

in a yield of 67% of the theoretical value.

$^1$H-NMR ($CDCl_3$): 7.75 (m,4H); 7.49 (m,6H); 4.31 (q,4H); 1.22 (t,6H).

Example A26:

14.93 g of N,N'-bis(t-butoxycarbonyl)-1,4-diketo-2,5-dihydro-3,6-diphenyl-pyrrolo[3,4-c]pyrrole prepared as described in Example A9 are recrystallized from 1.1 l of boiling ethanol. The red crystal precipitated is subjected to chromatography over a silica gel column using a methylene chloride/ethyl acetate (9:1) solvent system to give the diketopyrrolo[3,4-c]pyrrole of formula

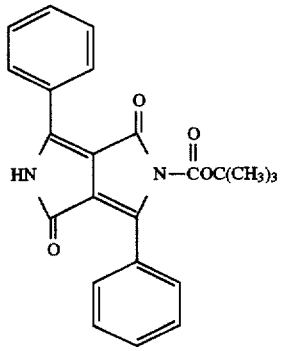

$^1$H-NMR ($CDCl_3$): 9.43 (s,br,1H); 8.30 (m,2H); 7.81 (m,2H); 7.51 (m,6H); 1.4 (s,9H).

Examples A27 to A33:

Mono-substituted compounds having the general formula

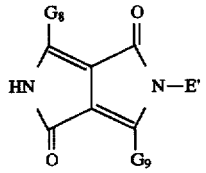

as listed below are prepared from the respective corresponding di-substituted pyrrolo-[3,4-c]pyrrole compounds, in the same manner as in Example A26.

| Example | $G_8$ | $G_9$ | E' | $^1$H-NMR ($CDCl_3$) |
|---|---|---|---|---|
| A27 | 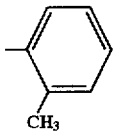 | 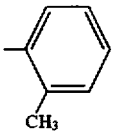 | 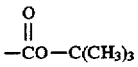 | 7.87(s, br, 1H); 7.80(d, 1H); 7.48–7.23 (m, 7H); 2.60(s, 3H); 2.45(s, 3H); 1.22 (s, 9H) |
| A28 | 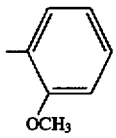 | 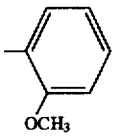 | 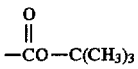 | 9.32(s, br, 1H); 9.24(d, 1H); 7.80 (d, 1H); 7.58–7.40(m, 2H); 7.20(t, 1H); 7.11(t, 1H); 7.01(d, 1H); 6.90(d, 1H); 3.99(s, 1H); 3.71(s, 3H); 1.37(s, 9H) |
| A29 | 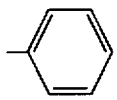 | 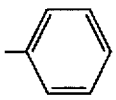 | 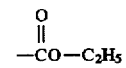 | 9.88(s, br, 1H); 8.34(d, 2H); 7.80 (m, 2H); 7.52(m, 6H); 4.35(q, 2H); 1.24 (t, 3H) |
| A30 | 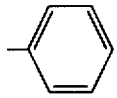 | 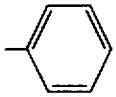 | 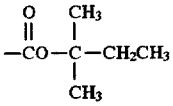 | 9.65(s, br, 1H); 8.31–8.33(m, 2H); 7.81–7.83(m, 2H); 7.50–7.56(m, 6H); 1.70 (q, 2H); 1.46(s, 6H); 0.80(t, 3H) |
| A31 | 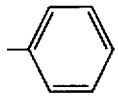 | 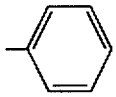 | 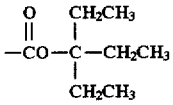 | 9.57(s, br, 1H); 8.26–8.36(m, 2H); 7.78–7.88(m, 2H); 7.48–7.60(m, 6H); 1.82–1.97(q ,6H); 0.78–0.92(t, 9H) |
| A32 | 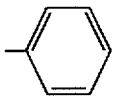 | 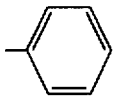 | 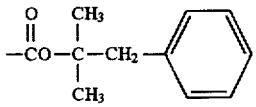 | 8.59(s, br, 1H); 8.20–8.29(m, 2H); 7.72–7.80(m, 2H); 7.42–7.61(m, 6H); 7.24 (s, 3H); 7.10–7.16(m, 2H); 3.00(s, 3H); 1.41(s, 6H) |

-continued

| Example | $G_8$ | $G_9$ | E' | $^1$H-NMR ($CDCl_3$) |
|---|---|---|---|---|
| A33 | 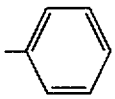 | 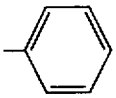 | 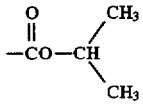 | 9.34(s, br, 1H); 8.25–8.36(m, 2H); 7.75–7.85(m, 2H); 7.48–7.60(m, 6H); 5.03–5.11(sept, 1H); (d, 6H) |

Example A34:

0.28 g (0.007 mol) of solid sodium hydride is added to a suspension of 0.5 g (0.00175 mol) of 1,4-diketo-2,5-dihydro-3,6-diphenyl-pyrrolo[3,4-c]pyrrole in 17 ml of tetrahydrofuran in an argon atmosphere. After the resulting mixture is stirred for 24 hours, 0.67 ml (0.007 mol) of n-butyl chloroformate is added thereto, and the resulting suspension is stirred overnight. The mixture is filtered, and the filtrate is concentrated under reduced pressure. The residue is taken into water/diethyl ether, and the organic phase is dried over $MgSO_4$ and then concentrated under reduced pressure. The residue is taken into n-hexane, and the yellow powder precipitated is collected by filtration, washed with a small amount of n-hexane to give 0.62 g (73% of the theoretical value) of N,N'-bis(n-butoxycarbonyl)-1,4-diketo-2,5-dihydro-3,6-diphenyl-pyrrolo[3,4-c]pyrrole as a yellow fluorescent powder.

$^1$H-NMR ($CDCl_3$): 7.72 (m,4H); 7.49 (m,6H); 4.32 (q,4H); 1.23 (t,6H).

B. Preparation of the Fine Particle Size Pigment

Example B1:

0.07 g of the product obtained in Example A1 are heated at 180° C. for 10 minutes in a test tube. The analytical data of the thus obtained purple powder all coincide with those of a pure quinacridone having the formula

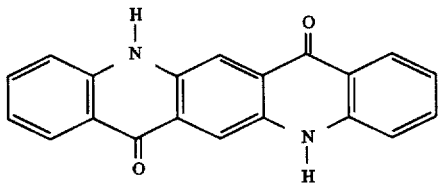

The yield (% conversion) is 99%.

Example B2:

0.07 g of the product obtained in Example A3 are dissolved in 1 ml of acetone, and the resulting solution is added at once to 1 ml of 33% HCl. The analytical data of the thus obtained red powder coincide with those of a pure pigment having the formula

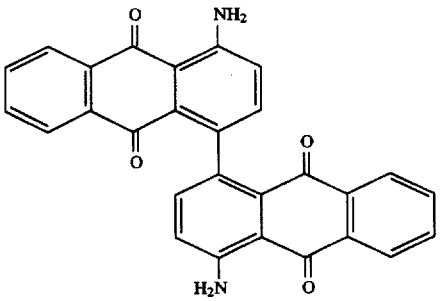

The conversion yield is 99%.

Example B3:

0.07 g of of N,N-bis(t-butoxycarbonyl)-1,4-diketo-2,5-dihydro-3,6-diphenyl-pyrrolo[3,4-c]pyrrole prepared as in Example A9 are heated at 180° C. for 10 minutes in a test tube. The analytical data of the thus formed red powder all coincide with those of 1,4-diketo-2,5-dihydro-3,6-diphenyl-pyrrolo[3,4-c]pyrrole. The yield is 99%.

Example B4:

0.07 g of N,N-bis(t-butoxycarbonyl)-1,4-diketo-2,5-dihydro-3,6-diphenyl-pyrrolo[3,4-c]pyrrole prepared in Example A9 are dissolved in 1 ml of acetone, and then the resulting solution is poured at once into 1 ml of 33% HCl. The analytical data obtained from the thus formed red powder all coincide with those of 1,4-diketo-2,5-dihydro-3,6-diphenyl-pyrrolo[3,4-c]pyrrole. The yield is 99%.

Example B5:

A suspension of 1.5 g of the product obtained in Example A10 and 5.1 g of toluene-4-sulfonic acid monohydride in 75 ml of tetrahydrofuran is refluxed under stirring for 15 hours and then cooled to 30° C. The precipitated pigment is isolated by filtration, washed successively with methanol and water and dried to give 0.55 g (57.2% of the theoretical value) of a red powder (β-type 1,4-diketo-3,6-diphenyl-pyrrolo[3,4-c]pyrrole).

| Analytical value: | C | H | N | CI |
|---|---|---|---|---|
| Calcd. | 60.53 | 2.82 | 7.84 | 19.85 |
| Found | 60.38 | 2.96 | 7.69 | 19.42 |

C. Preparation of Instant Electrophotographic Photoreceptors

Example C1:

0.3387 g of the product of Example A9 are dissolved in a solution of 3.446 g of a 0.65 wt % butyral resin (BM-S, manufactured by Sekisui Chemical Co., Ltd.) in THF to provide a charge generation layer composition (C1G).

A charge transportation layer composition (C1T) is prepared by dissolving 1.00 g of N,N'-bis(2,4-Dimethylphenyl)-N,N'-diphenyl-1,1'-biphenyl-4,4'-diamine and 1.00 g of polycarbonate (Z-200, manufactured by Mitsubishi Gas Chemical Co., Inc.) in 6.00 g of toluene.

The above charge generation layer composition (C1G) is applied onto an aluminum substrate using a wire bar (KCC rod No. 2, manufactured by RK Print-Coat Instruments) and dried at 45° C. for 30 minutes. Subsequently, the sample thus obtained is heat-treated at 170° C. for 20 minutes to confirm that the film formed on the aluminum substrate fully underwent color change from yellow to reddish orange. The charge transportation layer composition (C1T) is applied onto the thus formed charge generation layer (C1G) using a wire bar (KCC rod No. 8, manufactured by RK Print-Coat Instruments) and added at 50° C. for 60 minutes to obtain a double-layer electrophotographic photoreceptor.

Example C2:

0.3115 g of the product of Example A10 are dissolved in 5.946 g of a 0.38 wt % solution of butyral resin (BM-S) in 1,2-dichloroethane by stirring at 80° C. to provide a charge generation layer composition (C2G).

The thus obtained charge generation layer composition (C2G) is applied onto an aluminum substrate using a wire bar (No. 2) and dried at 45° C. for 30 minutes. Subsequently, the sample thus obtained is heat-treated at 155° C. for 15 minutes to confirm that the film formed on the aluminum substrate fully underwent color change from yellow to red. A double-layer electrophotographic photoreceptor is then prepared in the same manner as in Example C1.

Example C3:

0.300 g of the product of Example A11 are dissolved in 5.446 g of a 0.41 wt % solution of butyral resin (BM-S) in THF to provide a charge generation layer composition (C3G), which is then applied onto an aluminum substrate using a wire bar (No. 2) and dried at 45° C. for 30 minutes. Subsequently, the sample thus obtained is heat-treated at 150° C. for 30 minutes to confirm that the film formed on the aluminum substrate fully underwent color change from yellow to orange. A double-layer electrophotographic photoreceptor is then prepared in the same manner as in Example C1.

Example C4:

0.3282 g of the product of example A1 are dissolved in 5.446 g of a 0.41 wt % solution of butyral resin (BM-S) in dichloromethane to provide a charge generation layer composition (C4G), which is then applied onto an aluminum substrate using a wire bar (No. 2) and added at 45° C. for 30 minutes. Subsequently, the sample thus obtained is heat-treated at 150° C. for 20 minutes to confirm that the film formed on the aluminum substrate fully underwent color change from yellow to reddish purple. A double-layer electrophotographic photoreceptor is then prepared in the same manner as in Example C1, except that THF is used instead of toluene as a solvent.

Example C5:

0.0508 g of the product of Example A9, 0.50 g of N,N'-bis(2,4-dimethylphenyl)-N,N'-diphenyl-1,1'-biphenyl-4,4'-diamine and 0.50 g of a polycarbonate (Z-200, manufactured by Mitsubishi Gas Chemical Co., Inc.) are dissolved in 3.0 g of THF. The resulting solution is applied onto an aluminum substrate using a wire bar and added at 50° C. for 60 minutes. After formation of a film, the film is further heat-treated at 150° C. for 30 minutes to provide a single-layer electrophotographic photoreceptor.

Example C6:

A single-layer electrophotographic photoreceptor is prepared in the same manner as in Example C5, except that the product of Example A9 is replaced by 0.467 g of the product of Example A10 and that the heat treatment to be applied after formation of the film is carried out at 150° C. for 15 minutes.

Example C7:

A single-layer electrophotographic photoreceptor is prepared in the same manner as in Example C5, except that the product of Example A9 is replaced by 0.0450 g of the product of Example A11 and that the heat treatment to be applied after formation of the film is carried out at 150° C. for 60 minutes.

Example C8:

A single-layer electrophotographic photoreceptor is prepared in the same manner as in Example C5, except that the product of Example A9 is replaced by 0.0492 g of the product of Example A1 and that the heat treatment to be applied after formation of the film is carried out at 120° C. for 60 minutes.

Example C9:

1.524 g of the product of Example A9, 0.10 g of a butyral resin (BM-S, manufactured by Sekisui Chemical Co., Ltd.) and 1.134 g of paratoluenesulfonic acid in 60 g of cyclohexanone are refluxed at 110° C. for 300 minutes. A red precipitate is obtained, which is filtered out by suction and washed with water. The residue (C9R) is added at 80° C. for 12 hours to provide a resin-containing pigment.

0.20 g of the resin-containing pigment (C9R), 2.5 g of toluene and 10 g of glass beads (GB-603M, manufactured by Toshiba-Ballotini Co., Ltd.) are introduced into 30 ml volume brown sample vials. Each vial is shaken for 2, 4, 6, 8 or 10 hours on a shaking machine (SA-31, manufactured by Yamato Kagaku). The dispersions thus obtained are applied onto aluminum substrate using a wire bar (No. 2) and added, respectively. After drying, as in Example C1 a charge transportation layer composition (C1T) is further applied using a wire bar and dried to provide a double-layer electrophotographic photoreceptor. The prepared electrophotographic photoreceptor has a metallic luster, confirming that the pigment particles are very fine.

Example C10:

A double-layer electrophotographic photoreceptor is prepared as in Example C4, with the exception that the product of Example A1 is replaced by the product of formula

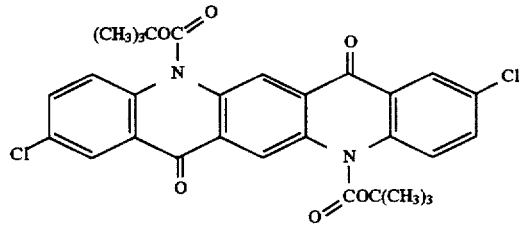

Examples C11–C27:

A double-layer electrophotographic photoreceptor is prepared as in Example C1, with the exception that the product of Example A9 is replaced by the products of Examples A2–A5, A8, A12, A16–A19, A21, A23 and A25–A29, respectively.

Examples C28–C40:

A single-layer electrophotographic photoreceptor is prepared as in Example C5, with the exception that the product of Example A1 is replaced by the product of Examples A6, A7, A13–A15, A20, A22, A24 and A30–A34, respectively.

D. Preparation of Comparative Electrophotographic Photoreceptors

Comparative Example D1:

0.20 g of pigmentary 1,4-diketo-2,5-dihydro-3,6-diphenyl-pyrrolo-[3,4-c]pyrrole of formula

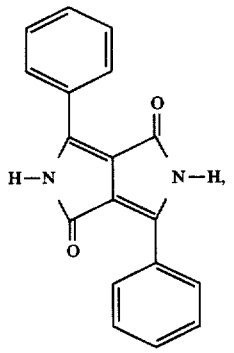

2.659 g of a 0.83 wt % butyral rosin (BM-S, manufactured by Sekisui Chemical Co., Ltd.) solution in toluene and 10 g of glass beads (GB-603M, manufactured by Toshiba-Ballotini Co., Ltd.) are introduced into a 30 ml volume brown sample vial which is then shaken on a shaking machine (SA-31, manufactured by Yamato Kagaku) for 20 hours to provide a control charge generation layer composition (D1G). After a dispersion is obtained, it is applied onto an aluminum substrate using a wire bar (No. 2) and dried at 50° C. for 30 minutes. The charge transportation layer composition (C1T) is applied onto the control charge generation layer (D1G) using a wire bar (No. 8) and added at 50° C. for 60 minutes to provide a control double-layer electrophotographic photoreceptor.

Comparative Example D2:

A control charge generation layer composition (D2G) and a control double-layer electrophotographic photoreceptor are prepared in the same manner as in Comparative Example D1, except that 1,4-diketo-2,5-dihydro-3,6-diphenyl-pyrrolo-[3,4-c]pyrrole is replaced by 1,4-diketo-2,5-dihydro-3,6-di(4-chloro-phenyl)-pyrrolo-[3,4-c]pyrrole of formula

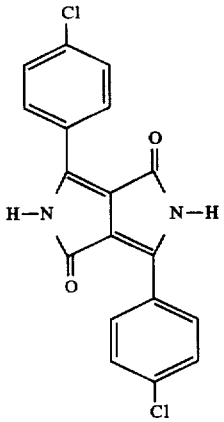

Comparative Example D3:

A control charge generation layer composition (D3G) and a control double-layer electrophotographic photoreceptor are prepared in the same manner as in Comparative Example D1, except that 1,4-diketo-2,5-dihydro-3,6-diphenyl-pyrrolo-[3,4-c]pyrrole is replaced by 1,4-diketo-2,5-dihydro-3,6-di(4-tert.-butyl-phenyl)-pyrrolo-[3,4-c]pyrrole of formula

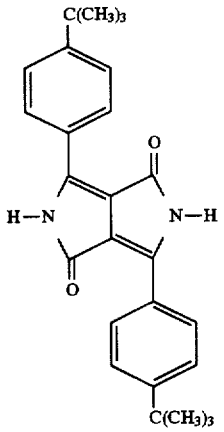

Comparative Example D4:

A control charge generation layer composition (D4G) and a control double-layer electrophotographic photoreceptor are prepared in the same manner as in Comparative Example D1, except that 1,4-diketo-2,5-dihydro-3,6-diphenyl-pyrrolo-[3,4-c]pyrrole is replaced by quinacridone of formula

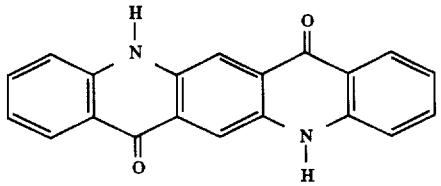

Comparative Example D5:

0.50 g of N,N'-bis(2,4-dimethylphenyl)-N,N'-diphenyl-1,1'-biphenyl-4,4'-diamine and 0.50 g of a polycarbonate (Z-200, manufactured by Mitsubishi Gas Chemical Co., Inc.) are dissolved in 2.6 g of toluene. Then, 0.429 g of the control charge generation layer composition (D1G) prepared in Comparative Example D1 are added thereto, followed by stirring using a stirrer for 10 minutes. The sample thus obtained is applied onto aluminum substrate using a wire bar (No. 8) and added at 50° C. for 60 minutes to provide a control single-layer electrophotographic photoreceptor.

Comparative Example D6:

A control single-layer electrophotographic photoreceptor is prepared in the same manner as in Comparative Example D5, except that the control charge generation layer composition (D1G) is replaced by the control charge generation layer composition (D2G) of Example D2.

Comparative Example D7:

A control single-layer electrophotographic photoreceptor is prepared in the same manner as in Comparative Example D5, except that the control charge generation layer composition (D1G) is replaced by the control charge generation layer composition (D3G) of Example D3.

Comparative Example D8:

A control single-layer electrophotographic photoreceptor is prepared in the same manner as in Comparative Example D5, except that the control charge generation layer composition (D1G) is replaced by the control charge generation layer composition (D4G) of Example D4.

Comparative Example D9:

Samples of the same charge generation layer composition (D1G) of Example D1 are subjected to the ball milling procedure of Example C9 for 2, 4, 6, 8 or 10 hours, and each thus treated sample is applied on aluminum substrate with a wire bar (No. 2) and dried. After drying, the charge transportation layer composition (C1T) is further applied using a wire bar (No. 8) and dried to provide a control double-layer electrophotographic photoreceptor, in the same manner as in Example 1.

E. Determination of Electrophotographic Properties

The electrophotographic properties of the electrophotographic photoreceptors obtained in Examples C1 to C9 as well as in Comparative Examples D1 to D9 are tested by means of a corona discharge using a static charging tester (EPA-8100, manufactured by Kawaguchi Denki Seisakusho). A negative electric charge is applied to the photoreceptors of Examples C1 to C4, D1 to D4, C9 and D9, whereas a positive electric charge is applied to the photoreceptors of Examples C5 to C8 and D5 to D8. The initial surface electric potential $V_0$ (v) of each photoreceptor is measured, and then the photoreceptor is irradiated with mono-chromatic light (10 μW/cm$^2$) so as to measure the time until the surface electric potential $V_0$ became half as much as that of the initial value to obtain half life exposure $E_{1/2}$ (μJ/cm$^2$). Further, the surface electric potential after 3.0 seconds is expressed in terms of $V_{res}$ (v). The results of determination are summarized in Tables 1 to 3.

TABLE 1

Double-layer photoreceptors (negative electric charge)

| Instant Example | $V_0$ | $E_{1/2}$ | $V_{res}$ | D.D. | Comparative Example | $V_0$ | $E_{1/2}$ | $V_{res}$ | D.D. |
|---|---|---|---|---|---|---|---|---|---|
| C1 | −1271 | 6.40 | −188 | 98.4 | D1 | −1047 | 21.9 | −370 | 95.7 |
| C2 | −1083 | 2.30 | −1 | 96.7 | D2 | −457 | 3.10 | −40 | 79.6 |
| C3 | −841 | 1.86 | −38 | 90.5 | D3 | −715 | 1.23 | −40 | 86.3 |
| C4 | −1002 | 6.30 | −121 | 97.7 | D4 | −1166 | — | −797 | 96.4 |

Corona electrical charging: −6.0 kV
$V_0$: Surface electric potential (v)
$V_{res}$: Residual electrical potential (v)
$E_{1/2}$: Electrophotographic sensitivity at 500 nm (μJ/cm$^2$) (C1 and D1)
Electrophotographic sensitivity at 550 nm (μJ/cm$^2$) (C2, C3, D2 and D3)
Electrophotographic sensitivity at 450 nm (μJ/cm$^2$) (C4 and D4)
D.D: Dark decay coefficient (%)

As shown in Table 1, the instant double-layered electrophotographic photoreceptors made from pigment precursors have improved photoelectric properties, as compared with prior art photoreceptors wherein the pigment has been dispersed.

TABLE 2

Single-layer photoreceptors (positive electric charge)

| Instant Example | $V_0$ | $E_{1/2}$ | $V_{res}$ | D.D. | Comparative Example | $V_0$ | $E_{1/2}$ | $V_{res}$ | D.D. |
|---|---|---|---|---|---|---|---|---|---|
| C5 | +762 | 3.65 | +39 | 94.2 | D5 | +984 | — | +656 | 97.9 |
| C6 | +708 | 3.05 | +6 | 91.9 | D6 | +993 | 20.65 | +372 | 97.9 |
| C7 | +219 | 5.40 | +37 | 92.7 | D7 | +919 | 6.85 | +245 | 95.6 |
| C8 | +907 | 5.55 | +76 | 96.7 | D8 | +666 | — | +609 | 97.3 |

Corona electrical charging: +6.0 kV
$V_0$: Surface electric potential (v)
$V_{res}$: Residual electrical potential (v)
$E_{1/2}$: Electrophotographic sensitivity at 500 nm (μJ/cm$^2$) (C5 and D5)
Electrophotographic sensitivity at 550 nm (μJ/cm$^2$) (C6, C7, D6 and D7)
Electrophotographic sensitivity at 450 nm (μJ/cm$^2$) (C8 and D8)
D.D: Dark decay coefficient (%)

As shown in Table 2, the instant single-layered electrophotographic photoreceptors made from pigment precursors have improved photoelectric properties, as compared with prior art photoreceptors wherein the pigment has been dispersed.

TABLE 3

Properties of photoreceptors made from resin-containing pigments

| Instant Example C9 | | | | | Comparative Example D9 | | | | |
|---|---|---|---|---|---|---|---|---|---|
| Time | $V_0$ | $E_{1/2}$ | $V_{res}$ | D.D. | Time | $V_0$ | $E_{1/2}$ | $V_{res}$ | D.D. |
| 2 | −971 | 18.05 | −271 | 96.6 | 2 | −1147 | — | −778 | 97.5 |
| 4 | −922 | 12.90 | −124 | 95.7 | 4 | −1137 | — | −663 | 97.1 |
| 6 | −932 | 13.30 | −134 | 96.1 | 6 | −1077 | 27.10 | −478 | 96.5 |
| 8 | −840 | 13.75 | −143 | 95.5 | 8 | −1021 | 18.00 | −271 | 95.2 |
| 10 | −697 | 10.35 | −60 | 91.4 | 10 | −1011 | 17.25 | −248 | 95.6 |

Corona electrical charging: −6.0 kV
Time: Milling time (h)
$V_0$: Surface electric potential (v)
$V_{res}$: Residual electrical potential (v)
$E_{1/2}$: Electrophotographic sensitivity at 550 nm (μJ/cm$^2$)
D.D: Dark decay coefficient (%)

As shown in Table 3, reinstated pigments made from pigment precursors are much more easily redispersed into a highly sensitive electrophotographic photoreceptor's photosensitive layer, as compared with prior art reinstated pigments. Much shorter dispersion (milling) times are needed to reach the same residual electrical potential.

We claim:

1. An electrophotographic photoreceptor comprising a conductive substrate and a photosensitive layer containing an organic pigment as a charge qenerating material, wherein said organic pigment is formed from a soluble organic pigment precursor of formula (I)

$$A(D_1)(D_2)_x \quad (I)$$

or a derivative thereof, wherein x is an integer from 0 to 4;

A represents a chromophore residue which is a perylene, a quinacridone, an azo compound, an anthraquinone, a phthalocyanine, a dioxazine, an isoindolinone, an isoindoline, an indigo, a quinophthalone or a pyrrolopyrrole, and has from 1 to 5N atoms bound to the $D_1$ and to the x $D_2$ groups, whereby each N atom of A is independently from the other bound to 0, 1 or 2 groups $D_1$, or $D_2$;

$D_1$, and $D_2$ are independently a group represented by the formula (IIa), (IIb), (IIc) or (IId),

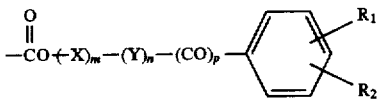
(IIa)

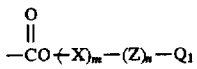
(IIb)

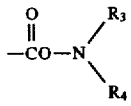
(IIc)

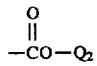
(IId)

wherein m, n and p are independent of each other 0 or 1;

X is a $C_1$–$C_{14}$ alkylene group or a $C_2$–$C_8$ alkenylene group;

Y is a group $-T_1-(CH_2)_q-$, wherein q is an integer of 1 to 6 and $T_1$ is a $C_3$–$C_6$ cycloalkylene group;

Z is a group $-T_1-(CH_2)_r-$, wherein r is an integer of 0 to 6 and $T_1$ has the same meaning as described above;

$R_1$ and $R_2$ represent independent of each other a hydrogen atom, a $C_1$–$C_6$ alkyl group, a $C_1$–$C_4$ alkoxy group, a halogen atom, a cyano group, a nitro group, or a phenyl or phenoxy group which may be substituted with $C_1$–$C_4$ alkyl, $C_1$–$C_4$ alkoxy or halogen;

$R_3$ and $R_4$ independent of each other represent a hydrogen atom or a $C_1$–$C_{18}$ alkyl group, a group of the formula

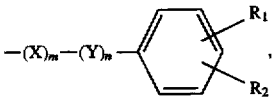

wherein X, Y, $R_1$, $R_2$, m and n have the same meanings as defined above; or $R_3$ and $R_4$ form together with the N atom to which they are attached a pyrrolidinyl group, a piperidinyl group or a morpholinyl group;

$Q_1$ represents a hydrogen atom, a cyano group or a group $Si(R_1)_3$, a group $-C(R_5)(R_6)(R_7)$ wherein $R_5$ is halogen and $R_6$ and $R_7$ are independently hydrogen or halogen, a group

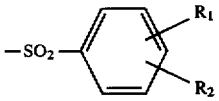

wherein $R_1$ and $R_2$ have the same meaning as described above, a group $-SO_2R_8$ or $-SR_8$ wherein $R_8$ is $C_1$–$C_4$ alkyl, a group $-CH(R_9)_2$ wherein $R_9$ is a phenyl or phenoxy group which may be substituted with $C_1$–$C_4$ alkyl, $C_1$–$C_4$ alkoxy or halogen, or a group of formula

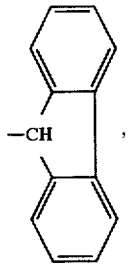

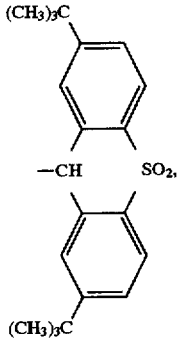

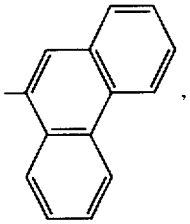

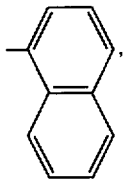

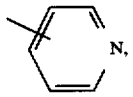

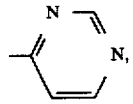

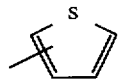

-continued or

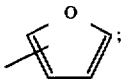

$Q_2$ represents a group of formula

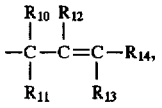

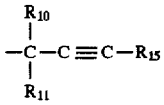

or

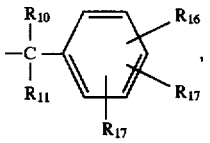

wherein $R_{10}$ and $R_{11}$ are independently hydrogen, $C_1$–$C_{24}$ alkyl, $C_1$–$C_{24}$ alkyl the chain of which is interrupted through O, S or $NR_{18}$, $C_3$–$C_{24}$ alkenyl, $C_3$–$C_{24}$ alkinil, $C_4$–$C_{12}$ cycloalkyl, $C_4$–$C_{12}$ cycloalkenyl, phenyl or biphenyl which is unsubstituted or substituted through $C_1$–$C_6$ alkyl, $C_1$–$C_6$ alkoxy, halogen, cyano or nitro;

$R_{12}$, $R_{13}$ and $R_{14}$ are independently hydrogen, $C_1$–$C_{24}$ alkyl or $C_3$–$C_{24}$ alkenyl;

$R_{15}$ is hydrogen, $C_1$–$C_{24}$ alkyl, $C_3$–$C_{24}$ alkenyl or a group of formula

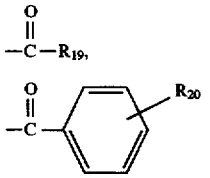

or

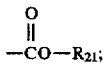

$R_{16}$ and $R_{17}$ are independently hydrogen, $C_1$–$C_6$ alkyl, $C_1$–$C_6$ alkoxy, halogen, cyano, nitro, $N(R_{18})(R_{19})$, phenyl which is unsubstituted or substituted through halogen, cyano, nitro, $C_1$–$C_6$ alkyl or $C_1$–$C_6$ alkoxy;

$R_{18}$ and $R_{19}$ are $C_1$–$C_6$ alkyl;

$R_{20}$ is hydrogen or $C_1$–$C_6$ alkyl; and $R_{21}$ is hydrogen, $C_1$–$C_6$ alkyl or phenyl which is unsubstituted or substituted through $C_1$–$C_6$ alkyl.

2. An electrophotographic photoreceptor according to claim 1, wherein in formula (I) x is 1 or 2; and $D_1$ and $D_2$ represent groups of formula (IIIa), (IIIb), (IIIc) or (IIId),

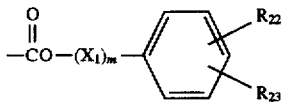

(IIIa)

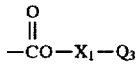

(IIIb)

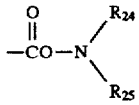

(IIIc)

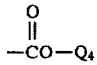

(IIId)

wherein m is 0 or 1; $X_1$ is a $C_1$–$C_4$ alkylene group or a $C_2$–$C_5$ alkenylene group;

$R_{22}$ and $R_{23}$ are independent of each other hydrogen, $C_1$–$C_4$ alkyl, methoxy, chloro or nitro;

$Q_3$ is hydrogen, cyano, trichloromethyl,

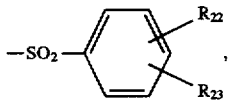

$SO_2CH_3$ or $SCH_3$;

$R_{24}$ and $R_{25}$ are independent of each other hydrogen, $C_1$–$C_4$ alkyl or

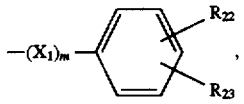

or $R_{24}$ and $R_{25}$ form together with the N atom to which they are attached a piperidinyl group;

and $Q_4$ is

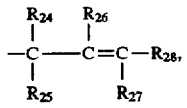

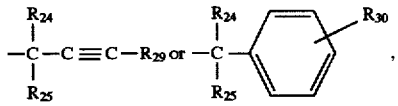

wherein $R_{24}$ to $R_{28}$ are independently from each other hydrogen or $C_1$–$C_{12}$ alkyl;

$R_{29}$ is hydrogen, $C_1$–$C_{12}$ alkyl,

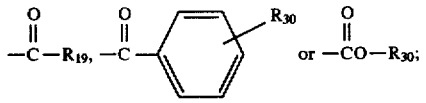

and $R_{30}$ is hydrogen or $C_1$–$C_4$ alkyl.

3. An electrophotographic photoreceptor according to claim 2, wherein in formula (I) x is 1 and $D_1$ and $D_2$ are identical groups

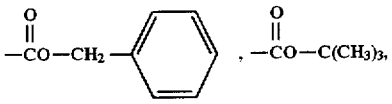

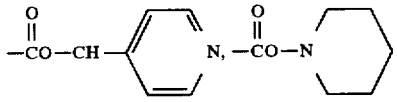

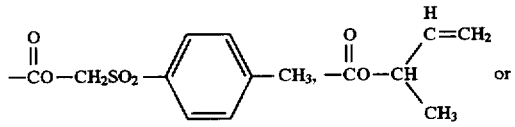

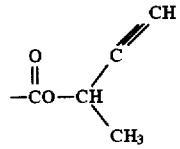

4. An electrophotographic photoreceptor according to claim 1, wherein said compound of formula (I) is a perylenecarboxyimide represented by the formula (IVa) or (IVb).

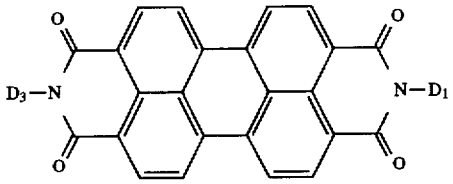

(IVa)

-continued

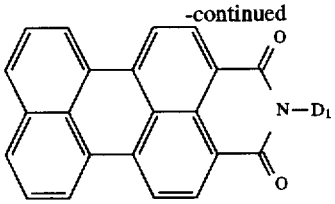

(IVb)

wherein $D_3$ represents a hydrogen atom, $C_1$–$C_6$ alkyl group, a phenyl, benzyl or phenethyl group which is unsubstituted or substituted with halogen or $C_1$–$C_4$ alkyl, or a group $D_1$.

5. An electrophotographic photoreceptor according to claim 1, wherein said compound of formula (I) is a quinacridone represented by the formula (V).

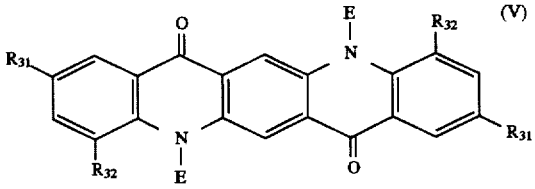

(V)

wherein $R_{31}$ and $R_{32}$ independent of each other represent a hydrogen atom, a halogen atom, a $C_1$–$C_{18}$ alkyl group, a $C_1$–$C_4$ alkoxy group or a phenyl group; and E represents a hydrogen atom or a group $D_1$, provided that at least one E is a group $D_1$.

6. An electrophotographic photoreceptor according to claim 1, wherein said compound of formula (I) is a dioxazine represented by the formula (VI).

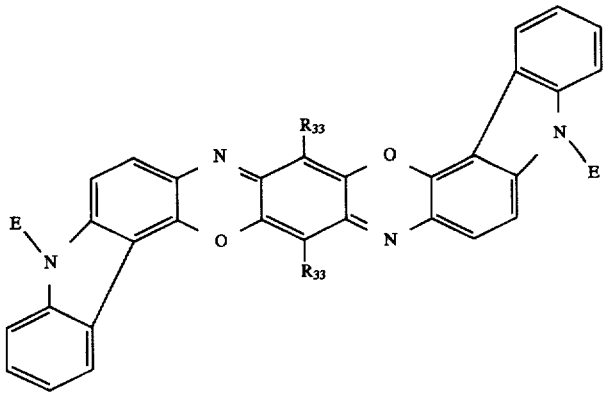

(VI)

wherein $R_{33}$ represents a hydrogen atom, a halogen atom or a $C_1$–$C_{18}$ alkyl group; and E represents a hydrogen atom or a group $D_1$, provided that at least one E is a group $D_1$.

7. An electrophotographic photoreceptor according to claim 1, wherein said compound of formula (I) is an isoindoline represented by the formula (VIIa), (VIIb) or (VIIc).

(VIIa)

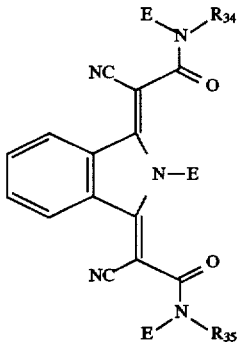

(VIIb)

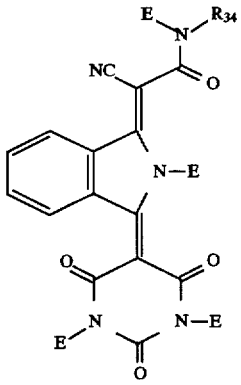

(VIIc)

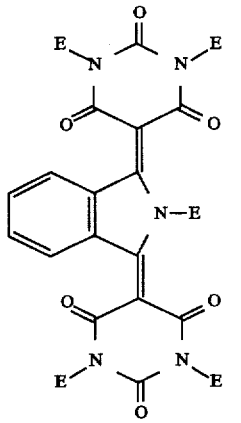

wherein $R_{34}$ represents a group of the formula

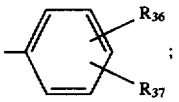

$R_{35}$ represents a hydrogen atom, a $C_1$–$C_{18}$ alkyl group, a benzyl group or a group of the formula

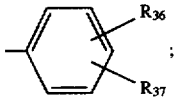

$R_{36}$ and $R_{37}$ represent independent of each other a hydrogen atom, a $C_1$–$C_{18}$ alkyl group, a $C_1$–$C_4$ alkoxy group, a halogen atom or a trifluoromethyl group; and E represents a hydrogen atom or a group $D_1$, provided that at least one E is a group $D_1$.

8. An electrophotographic photoreceptor according to claim 1, wherein said compound of formula (I) is an indigo represented by the formula (VIII), (VIII)

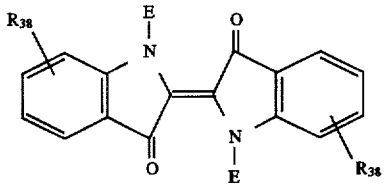

wherein $R_{38}$ represents a hydrogen atom, a cyano group, a $C_1$–$C_4$ alkyl group, a $C_1$–$C_4$ alkoxy group or a halogen atom; and E represents a hydrogen atom or a group $D_1$, provided that at least one E is a group $D_1$.

9. An electrophotographic photoreceptor according to claim 1, wherein said compound of formula (I) is an azobenzimidazolone represented by the formula (IX), (IX)

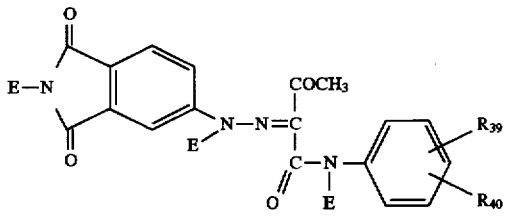

wherein $R_{39}$ and $R_{40}$ independent of each other represent a hydrogen atom, a halogen atom, a $C_1$–$C_4$ alkyl group or a $C_1$–$C_4$ alkoxy group; and E represents a hydrogen atom or a group $D_1$, provided that at least one E is a group $D_1$.

10. An electrophotographic photoreceptor according to claim 1, wherein said compound of formula (I) is an anthraquinoid compound represented by the formula (X), (X)

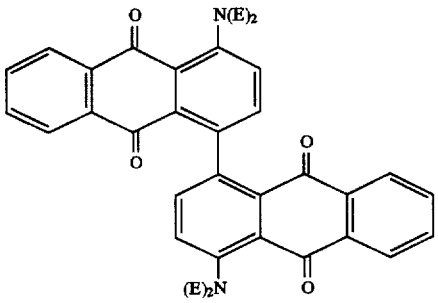

wherein E represents a hydrogen atom or a group $D_1$, provided that at least one E is a group $D_1$.

11. An electrophotographic photoreceptor according to claim 1, wherein said compound of formula (I) is a phthalocyanine represented by the formula (XI), (XI)

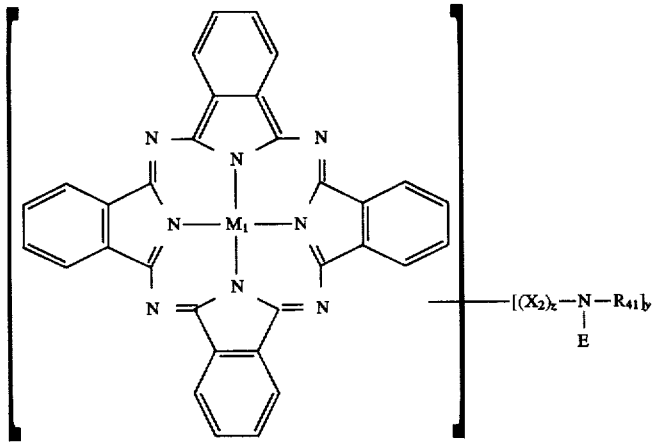

wherein $M_1$ represents $H_2$, Zn, Cu, Ni, Fe, Ti(O) or V(O); $X_2$ represents —$CH(R_{42})$— or $SO_2$; and $R_{41}$ represents a hydrogen atom, a $C_1$–$C_4$ alkyl group, $N(E)R_{42}$, —$NHCOR_{43}$, —$COR_{43}$ or a group of the formula

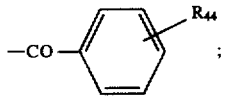

$R_{42}$ represents a hydrogen atom or a $C_1$–$C_4$ alkyl group; $R_{43}$ represents a $C_1$–$C_4$ alkyl group; $R_{44}$ represents a hydrogen atom, a halogen atom, a $C_1$–$C_4$ alkoxy group; z is 0 or 1; y is an integer of 1 to 4; and E represents a hydrogen atom or a group $D_1$, provided that at least one E is a group $D_1$.

12. An electrophotographic photoreceptor according to claim 1, wherein said compound of formula (I) is a pyrrolo [3,4-c]pyrrole represented by the formula (XII), (XII)

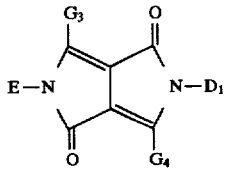

wherein $G_3$ and $G_4$ independent of each other represent a group of the formula

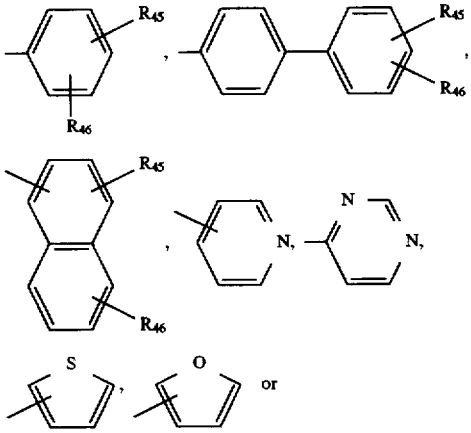

-continued

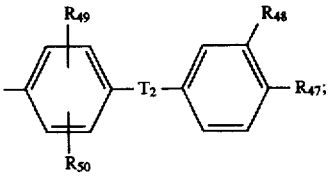

$R_{45}$ and $R_{46}$ independently of each other represent hydrogen, halogen, $C_1$–$C_{18}$ alkyl, $C_1$–$C_{18}$ alkoxy, $C_1$–$C_{18}$ alkylmercapto, $C_1$–$C_{18}$ alkylamino, cyano, nitro, phenyl, trifluoromethyl, $C_5$–$C_6$ cycloalkyl, —CH=N—($C_1$–$C_{18}$alkyl),

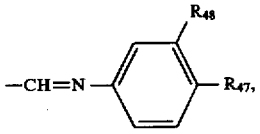

imidazolyl, pyrazolyl, triazolyl, piperazinyl, pyrrolyl, oxazolyl, benzoxazolyl, benzothiazolyl, benzimidazolyl, morpholinyl, piperidinyl or pyrrolidinyl; $T_2$ represents —$CH_2$—, —$CH(CH_3)$—, —$(CH_3)_2$—, —CH=N—, —N=N—, —O—, —S—, —SO—, —$SO_2$— or —$NR_{51}$—; $R_{47}$ and $R_{48}$ represent independent of each other hydrogen, halogen, $C_1$–$C_6$ alkyl, $C_1$–$C_{18}$ alkoxy or cyano; $R_{49}$ and $R_{50}$ represent independent of each other hydrogen, halogen or $C_1$–$C_6$ alkyl; $R_{51}$ represents hydrogen or $C_1$–$C_6$ alkyl; E represents a hydrogen atom or a group $D_1$, provided that at least one E is a group $D_1$.

13. An electrophotographic photoreceptor according to claim 1, wherein said compound of formula (I) is an isoindoline represented by the (XIIIa) or (XIIIb).

(XIIIa)

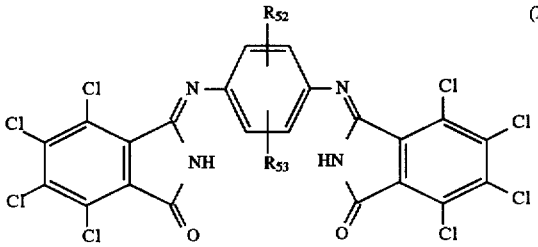

(XIIIb)

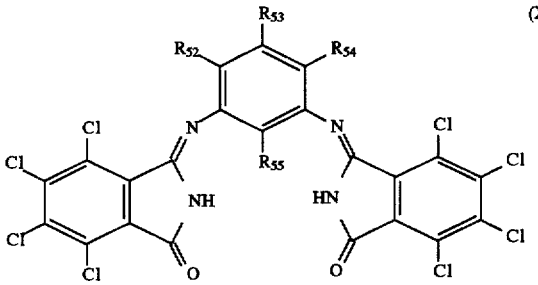

wherein $R_{52}$, $R_{53}$, $R_{54}$ and $R_{55}$ are each independently of the other hydrogen, $C_1$–$C_{18}$-alkyl, $C_1$–$C_4$-alkoxy, halogen or trifluoromethyl.

14. An electrophotographic photoreceptor according to claim 12, wherein in formula (XII) $G_3$ and $G_4$ represent independently of each other a group of the formula

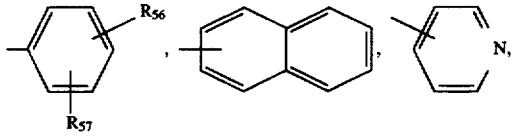

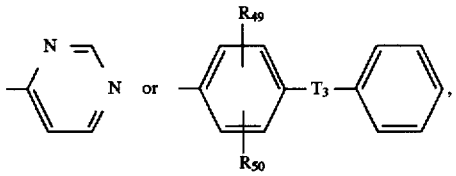

wherein $R_{56}$ and $R_{57}$ represent independently of each other hydrogen, chlorine, bromine, $C_1$–$C_4$ alkyl, $C_1C_6$ alkoxy, $C_1$–$C_6$ alkylamino, cyano or phenyl; and $T_3$ represents —O—, —NH—, —N($CH_3$)—, —N($C_2H_5$)—, —N=N— or —$SO_2$—.

15. An electrophotographic photoreceptor according to claim 14, wherein in formula (XII) $G_3$ and $G_4$ each represent a group of the formula

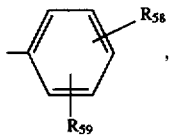

wherein $R_{58}$ and $R_{59}$ represent independently of each other hydrogen, methyl, tert.-butyl, chlorine, bromine, cyano or phenyl.

16. An electrophotographic photoreceptor comprising a conductive substrate and a photosensitive layer containing an organic pigment as a charge generating material, wherein said organic pigment is formed from a soluble organic pigment precursor of formula (XIV), (XIV)

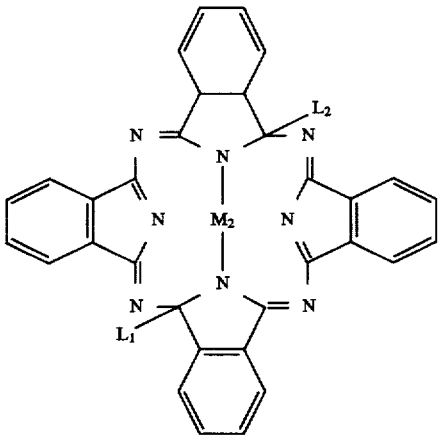

wherein $L_1$ and $L_2$ are independently from one other halogen, $C_1$–$C_{18}$ alkoxy, $C_2$–$C_{18}$ dialkylamino, $C_1$–$C_{18}$ cycloalkylamino, (N'-$C_1$–$C_6$alkyl)piperidino or morpholino, and $M_2$ stands for two hydrogens or a metal or oxometal with at least two valences; or a derivative thereof.

17. An electrophotographic photoreceptor according to claim 16, wherein in formula (XIV) $M_2$ is $H_2$, Zn, Cu, Ni, Fe, Ti(O) or V(O), and $L_1$ and $L_2$ are independently from one other $C_2$–$C_{18}$ dialkylamino, $C_1$–$C_{18}$ cycloalkylamino, (N'—$C_1$–$C_6$alkyl)piperidino or morpholino; or a derivative thereof where the phenyl groups are substituted by 1 to 16 bromo or chloro.

18. A method of preparation of an electrophotographic photoreceptor according to claim 1 or claim 16, comprising the steps of (1) forming a layer containing a soluble organic pigment precursor on the conductive substrate; and (2) regenerating said charge generating organic pigment chemically from the soluble organic pigment precursor.

19. The method of claim 18, wherein the pigment precursor is converted to the pigment by (a) heating to 50° to 150° C. together with an inorganic acid or an organic acid, and then cooling to 30° C. or lower; or (b) heating to 120° to 350° C. in the absence of an acid.

20. A method of using an electrophotographic process, characterized in that in said process electrical charges are generated on an electrophotographic photoreceptor according to claim 1 or claim 16.

21. The method of claim 18, wherein the pigment precursor is a compound of claim 16, and is converted to the pigment by (a) heating to 50° to 150° C. together with an inorganic acid or an organic acid, and then cooling to 30° C. or lower, or (b) heating to 120° to 350° C. in the absence of an acid.

* * * * *